US012752893B2

(12) United States Patent
Jing et al.

(10) Patent No.: US 12,752,893 B2
(45) Date of Patent: Oct. 6, 2026

(54) ROBOTIC FISH WITH CONTROLLED BISTABLE ELASTIC PROPULSION SYSTEM

(71) Applicant: City University of Hong Kong, Kowloon (HK)

(72) Inventors: Xingjian Jing, Shatin (HK); Xu Chao, Kowloon Bay (HK)

(73) Assignee: City University of Hong Kong, Kowloon (HK)

( * ) Notice: Subject to any disclaimer, the term of this patent is extended or adjusted under 35 U.S.C. 154(b) by 250 days.

(21) Appl. No.: 18/749,778

(22) Filed: Jun. 21, 2024

(65) Prior Publication Data

US 2025/0388308 A1 Dec. 25, 2025

(51) Int. Cl.
*B63H 1/36* (2006.01)

(52) U.S. Cl.
CPC ..... *B63H 1/36* (2013.01)

(58) Field of Classification Search
CPC ..... B63H 1/36; B63G 8/00
See application file for complete search history.

(56) References Cited

U.S. PATENT DOCUMENTS

2020/0115018 A1* 4/2020 Aukes ..... B63H 1/36
2021/0276678 A1* 9/2021 Yao ..... B63G 8/001

FOREIGN PATENT DOCUMENTS

CN 101318546 A * 12/2008

OTHER PUBLICATIONS

Sfakiotakis, M., Lane, D. M. & Davies, J. B. C. Review of fish swimming modes for aquatic locomotion. IEEE Journal of oceanic engineering 24, 237-252 (1999).

Wang, R., Wang, S., Wang, Y., Cheng, L. & Tan, M. Development and motion control of biomimetic underwater robots: A survey. IEEE Transactions on Systems, Man, and Cybernetics: Systems 52, 833-844 (2020).

Di Santo, V. et al. Convergence of undulatory swimming kinematics across a diversity of fishes. Proceedings of the National Academy of Sciences 118, e2113206118 (2021).

Scaradozzi, D., Palmieri, G., Costa, D. & Pinelli, A. BCF swimming locomotion for autonomous underwater robots: a review and a novel solution to improve control and efficiency. Ocean Engineering 130, 437-453 (2017).

(Continued)

*Primary Examiner* — Stephen P Avila
(74) *Attorney, Agent, or Firm* — Renner, Kenner, Greive, Bobak, Taylor & Weber

(57) ABSTRACT

A device for providing propulsion in water that includes an elongated elastic member, a parallel linkage mechanism with a first link and a second link, and a propelling member connected to a free end of the elongated elastic member. A first end of the first link is fixedly located relative to a fixed end of the elongated elastic member and adapted to pivot by a first servo motor. A first end of the second link is fixedly located relative to the fixed end of the elongated elastic member and adapted to pivot by a second servo motor. A second end of the first link and a second end of the second link are pivotally connected to each other, as well as to the free end of the elongated elastic member, to form a passive rotational joint. A high-efficiency fishtail designed through nonlinear bi-stable mechanism can be provided.

15 Claims, 24 Drawing Sheets

(56) References Cited

OTHER PUBLICATIONS

Li, Z. et al. Biomimetic omnidirectional multi-tail underwater robot. Mechanical Systems and Signal Processing 173, 109056 (2022).
Li, L. et al. Bottom-level motion control for robotic fish to swim in groups: modeling and experiments. Bioinspiration & biomimetics 14, 046001 (2019).
Huang, Z. et al. Impact of caudal fin geometry on the swimming performance of a snake-like robot. Ocean Engineering 245, 110372 (2022).
Crespi, A. & Ijspeert, A. J. Online optimization of swimming and crawling in an amphibious snake robot. IEEE Transactions on robotics 24, 75-87 (2008).
Yan, S., Wu, Z., Wang, J., Tan, M. & Yu, J. Efficient cooperative structured control for a multijoint biomimetic robotic fish. IEEE/ASME Transactions on Mechatronics 26, 2506-2516 (2020).
Li, L. et al. Vortex phase matching as a strategy for schooling in robots and in fish. Nature communications 11, 5408 (2020).
Nguyen, D. Q. & Ho, V. A. Anguilliform swimming performance of an eel-inspired soft robot. Soft Robotics 9, 425-439 (2022).
Marchese, A. D., Onal, C. D. & Rus, D. Autonomous soft robotic fish capable of escape maneuvers using fluidic elastomer actuators. Soft robotics 1, 75-87 (2014).
Zhou, W. & Li, Y. Modeling and analysis of soft pneumatic actuator with symmetrical chambers used for bionic robotic fish. Soft Robotics 7, 168-178 (2020).
Yuk, H. et al. Hydraulic hydrogel actuators and robots optically and sonically camouflaged in water. Nature communications 8, 14230 (2017).
Guo, S., Fukuda, T. & Asaka, K. A new type of fish-like underwater microrobot. Ieee/Asme Transactions on Mechatronics 8, 136-141 (2003).
Aureli, M., Kopman, V. & Porfiri, M. Free-locomotion of underwater vehicles actuated by ionic polymer metal composites. IEEE/ASME transactions on mechatronics 15, 603-614 (2009).
Chen, Z., Shatara, S. & Tan, X. Modeling of biomimetic robotic fish propelled by an ionic polymer-metal composite caudal fin. IEEE/ASME transactions on mechatronics 15, 448-459 (2009).
Lou, J. et al. Effects of actuator-substrate ratio on hydrodynamic and propulsion performances of underwater oscillating flexible structure actuated by macro fiber composites. Mechanical Systems and Signal Processing 170, 108824 (2022).
Li, G. et al. Self-powered soft robot in the Mariana Trench. Nature 591, 66-71 (2021).
Tissot-Daguette, L., Schneegans, H., Thalmann, E. & Henein, S. Analytical modeling and experimental validation of rotationally actuated pinned-pinned and fixed-pinned buckled beam bistable mechanisms. Mechanism and Machine Theory 174, 104874 (2022).
Currier, T. M., Lheron, S. & Modarres-Sadeghi, Y. A bio-inspired robotic fish utilizes the snap-through buckling of its spine to generate accelerations of more than 20g. Bioinspiration & Biomimetics 15, 055006 (2020).
Chen, T., Bilal, O. R., Shea, K. & Daraio, C. Harnessing bistability for directional propulsion of soft, untethered robots. Proceedings of the National Academy of Sciences 115, 5698-5702 (2018).
Koh, J.-S. et al. Jumping on water: Surface tension-dominated jumping of water striders and robotic insects. Science 349, 517-521 (2015).
Tang, Y. et al. Leveraging elastic instabilities for amplified performance: Spine-inspired high-speed and high-force soft robots. Science advances 6, eaaz6912 (2020).
Xiong, Z., Su, Y. & Lipson, H. Fast untethered soft robotic crawler with elastic instability, in 2023 IEEE International Conference on Robotics and Automation (ICRA). 2606-2612 (IEEE).
Chi, Y., Hong, Y., Zhao, Y., Li, Y. & Yin, J. Snapping for high-speed and high-efficient butterfly stroke-like soft swimmer. Science Advances 8, eadd3788 (2022).
Zhong, Q. et al. Tunable stiffness enables fast and efficient swimming in fish-like robots. Science Robotics 6, eabe4088 (2021).
Chen, D., Wu, Z., Dong, H., Tan, M. & Yu, J. Exploration of swimming performance for a biomimetic multi-joint robotic fish with a compliant passive joint. Bioinspiration & Biomimetics 16, 026007 (2020).
Zhu, J. et al. Tuna robotics: A high-frequency experimental platform exploring the performance space of swimming fishes. Science Robotics 4, eaax4615 (2019).
White, C. H., Lauder, G. V. & Bart-Smith, H. Tunabot Flex: A tuna-inspired robot with body flexibility improves high-performance swimming. Bioinspiration & Biomimetics 16, 026019 (2021).
Bujard, T., Giorgio-Serchi, F. & Weymouth, G. D. A resonant squid-inspired robot unlocks biological propulsive efficiency. Science Robotics 6, eabd2971 (2021).
Katzschmann, R. K., DelPreto, J., MacCurdy, R. & Rus, D. Exploration of underwater life with an acoustically controlled soft robotic fish. Science Robotics 3, eaar3449 (2018).
Chen, B. & Jiang, H. Swimming performance of a tensegrity robotic fish. Soft robotics 6, 520-531 (2019).
Liu, S., Liu, C., Liang, Y., Ren, L. & Ren, L. Tunable Stiffness Caudal Peduncle Leads to Higher Swimming Speed without Extra Energy. IEEE Robotics and Automation Letters (2023).
Chen, B. & Jiang, H. Body stiffness variation of a tensegrity robotic fish using antagonistic stiffness in a kinematically singular configuration. IEEE Transactions on Robotics 37, 1712-1727 (2021).
Zhong, Y., Li, Z. & Du, R. A novel robot fish with wire-driven active body and compliant tail. IEEE/ASME Transactions on Mechatronics 22, 1633-1643 (2017).
Liao, X., Zhou, C., Zou, Q., Wang, J. & Lu, B. Dynamic Modeling and Performance Analysis for a Wire-Driven Elastic Robotic Fish. IEEE Robotics and Automation Letters 7, 11174-11181 (2022).
Ng, T. J., Chen, N. & Zhang, F. Snapp: An Agile Robotic Fish with 3-D Maneuverability for Open Water Swim. IEEE Robotics and Automation Letters (2023).
Chen, D., Wu, Z., Meng, Y., Tan, M. & Yu, J. Development of a high-speed swimming robot with the capability of fish-like leaping. IEEE/ASME Transactions on Mechatronics 27, 3579-3589 (2022).
Wang, X. et al. Toward Propulsive Performance Evaluation of a Robotic Tuna Based on the Damping-Elastic Composite Mechanism. IEEE/ASME Transactions on Mechatronics (2023).
Liao, X., Zhou, C., Wang, J. & Tan, M. A Wire-Driven Dual Elastic Fishtail With Energy Storing and Passive Flexibility. IEEE/ASME Transactions on Mechatronics (2023).
Du, S., Wu, Z., Wang, J., Qi, S. & Yu, J. Design and control of a two-motor-actuated tuna-inspired robot system. IEEE Transactions on Systems, Man, and Cybernetics: Systems 51, 4670-4680 (2019).
Videler, J. & Wardle, C. Fish swimming stride by stride: speed limits and endurance. Reviews in Fish Biology and Fisheries 1, 23-40 (1991).
Kopman, V. & Porfiri, M. Design, modeling, and characterization of a miniature robotic fish for research and education in biomimetics and bioinspiration. IEEE/ASME Transactions on mechatronics 18, 471-483 (2012).
Ma, F. & Chen, G. Modeling large planar deflections of flexible beams in compliant mechanisms using chained beam-constraint-model. Journal of Mechanisms and Robotics 8, 021018 (2016).

* cited by examiner

A Tunabot [31]
B HCMfish robot[27]
C SoFi[32]
D Tensegrity robotic fish [33]
E HasorTuna[34]
F TenFiBot [35]
G ACPM robotic fish [36]
H WE-Rofi[37]
I Snapp[38]
J Leaping fish robot [39]
K Robotic tuna[40]
L WH-Rofi[41]
M CasiTuna [42]
★ This work

ROBOTIC FISH WITH CONTROLLED BISTABLE ELASTIC PROPULSION SYSTEM

FIELD OF INVENTION

This invention relates to robots used in underwater environment, and in particular to such robots with a compliant propulsion system.

BACKGROUND OF INVENTION

High maneuverability and energy efficiency are crucial for underwater robots to perform tasks in engineering practice. Natural evolution empowers aquatic species with skills of agile and efficient swimming, which can all be deliberately employed for better robotic swimmers. A critical issue for efficient robotic swimmers is the appropriate design and control of an appropriate propulsion system.

Body-and-caudal-fin (BCF) propulsion is a popular biomimetic method for driving bio-inspired underwater robots due to its simplicity in implementation with reasonable speed and energy consumption. Such propulsion methods produce little noise and present very friendly and natural interference with aquatic environments, and consequently have more convenient applications for close-up observation of marine animals compared to traditional propeller-based systems. It is also worth noting that fish are naturally endowed with the capability of agile swimming maneuvers as a result of their ingenious locomotion control of tails. In a complex and unstructured underwater environment, outstanding maneuverability is crucial for robots to carry out different tasks. Therefore, it is critical to endow robotic swimmers with similar swimming skills through the tail design and control.

Many robotic swimmers have been designed in the past two decades with different swimming fish morphologies, which can be classified into discrete and continuous bodies. A discrete body design may result in some salient drawbacks such as large friction loss which could lead to low propulsion efficiency and thus limitations in further performance improvement. Researchers thus attempt to use soft materials to achieve continuous compliant fish bodies, such as hydraulic actuated soft tail, smart soft actuation materials like ionic polymer-metal composites (IPMCS), macro fiber composites (MFCs) and dielectric elastomers (DEs). A noticeable issue in these results is that they tend to produce relatively weak thrust, and thus it is difficult to control body motion for high agility and maneuverability accurately, and even more challenging working in dynamic water environments.

To address these shortcomings of existing fish-like robots, various studies have been conducted. Elastic instability of bistable or multi-stable structures can induce an interesting bi-stable snap-through phenomenon i.e., quickly storing and releasing strain energy. During this process, remarkable force amplification and rapid morphing can be achieved as two characteristics of elastic instability which can be further utilized to enhance the performance of soft robots effectively. However, although all these mentioned soft robots can perform the snap-through motion mode, all lack dexterous and accurate controllability of the underlying bistable nonlinear dynamics, thus resulting in poor maneuverability and difficulty for potential practical deployment.

REFERENCES

The following references are referred to throughout this specification, as indicated by the numbered brackets. The disclosures of each of these references are hereby incorporated by reference herein in their entireties for all purposes.

[1] Sfakiotakis, M., Lane, D. M. & Davies, J. B. C. Review of fish swimming modes for aquatic locomotion. IEEE Journal of oceanic engineering 24, 237-252 (1999).

[2] Wang, R., Wang, S., Wang, Y., Cheng, L. & Tan, M. Development and motion control of biomimetic underwater robots: A survey. IEEE Transactions on Systems, Man, and Cybernetics: Systems 52, 833-844 (2020).

[3] Di Santo, V. et al. Convergence of undulatory swimming kinematics across a diversity of fishes. Proceedings of the National Academy of Sciences 118, e2113206118 (2021).

[4] Scaradozzi, D., Palmieri, G., Costa, D. & Pinelli, A. BCF swimming locomotion for autonomous underwater robots: a review and a novel solution to improve control and efficiency. Ocean Engineering 130, 437-453 (2017).

[5] Marras, S. & Porfiri, M. Fish and robots swimming together: attraction towards the robot demands biomimetic locomotion. Journal of The Royal Society Interface 9, 1856-1868 (2012).

[6] Lauder, G. V., Anderson, E. J., Tangorra, J. & Madden, P. G. Fish biorobotics: kinematics and hydrodynamics of self-propulsion. Journal of experimental biology 210, 2767-2780 (2007).

[7] Li, Z. et al. Biomimetic omnidirectional multi-tail underwater robot. Mechanical Systems and Signal Processing 173, 109056 (2022).

[8] Li, L. et al. Bottom-level motion control for robotic fish to swim in groups: modeling and experiments. Bioinspiration & biomimetics 14, 046001 (2019).

[9] Huang, Z. et al. Impact of caudal fin geometry on the swimming performance of a snake-like robot. Ocean Engineering 245, 110372 (2022).

[10] Crespi, A. & Ijspeert, A. J. Online optimization of swimming and crawling in an amphibious snake robot. IEEE Transactions on robotics 24, 75-87 (2008).

[11] Yan, S., Wu, Z., Wang, J., Tan, M. & Yu, J. Efficient cooperative structured control for a multijoint biomimetic robotic fish. IEEE/ASME Transactions on Mechatronics 26, 2506-2516 (2020).

[12] Li, L. et al. Vortex phase matching as a strategy for schooling in robots and in fish. Nature communications 11, 5408 (2020).

[13] Nguyen, D. Q. & Ho, V. A. Anguilliform swimming performance of an eel-inspired soft robot. Soft Robotics 9, 425-439 (2022).

[14] Marchese, A. D., Onal, C. D. & Rus, D. Autonomous soft robotic fish capable of escape maneuvers using fluidic elastomer actuators. Soft robotics 1, 75-87 (2014).

[15] Zhou, W. & Li, Y. Modeling and analysis of soft pneumatic actuator with symmetrical chambers used for bionic robotic fish. Soft Robotics 7, 168-178 (2020).

[16] Yuk, H. et al. Hydraulic hydrogel actuators and robots optically and sonically camouflaged in water. Nature communications 8, 14230 (2017).

[17] Guo, S., Fukuda, T. & Asaka, K. A new type of fish-like underwater microrobot. Ieee/Asme Transactions on Mechatronics 8, 136-141 (2003).

[18] Aureli, M., Kopman, V. & Porfiri, M. Free-locomotion of underwater vehicles actuated by ionic polymer metal composites. IEEE/ASME transactions on mechatronics 15, 603-614 (2009).

[19] Chen, Z., Shatara, S. & Tan, X. Modeling of biomimetic robotic fish propelled by an ionic polymer-metal composite caudal fin. IEEE/ASME transactions on mechatronics 15, 448-459 (2009).

[20] Lou, J. et al. Effects of actuator-substrate ratio on hydrodynamic and propulsion performances of underwater oscillating flexible structure actuated by macro fiber composites. Mechanical Systems and Signal Processing 170, 108824 (2022).

[21] Li, G. et al. Self-powered soft robot in the Mariana Trench. Nature 591, 66-71 (2021).

[22] Tissot-Daguette, L., Schneegans, H., Thalmann, E. & Henein, S. Analytical modeling and experimental validation of rotationally actuated pinned-pinned and fixed-pinned buckled beam bistable mechanisms. Mechanism and Machine Theory 174, 104874 (2022).

[23] Currier, T. M., Lheron, S. & Modarres-Sadeghi, Y. A bio-inspired robotic fish utilizes the snap-through buckling of its spine to generate accelerations of more than 20 g. Bioinspiration & Biomimetics 15, 055006 (2020).

[24] Chen, T., Bilal, O. R., Shea, K. & Daraio, C. Harnessing bistability for directional propulsion of soft, untethered robots. Proceedings of the National Academy of Sciences 115, 5698-5702 (2018).

[25] Koh, J.-S. et al. Jumping on water: Surface tension-dominated jumping of water striders and robotic insects. Science 349, 517-521 (2015).

[26] Tang, Y. et al. Leveraging elastic instabilities for amplified performance: Spine-inspired high-speed and high-force soft robots. Science advances 6, eaaz6912 (2020).

[27] Xiong, Z., Su, Y. & Lipson, H. Fast untethered soft robotic crawler with elastic instability, in 2023 IEEE International Conference on Robotics and Automation (ICRA). 2606-2612 (IEEE).

[28] Chi, Y., Hong, Y., Zhao, Y., Li, Y. & Yin, J. Snapping for high-speed and high-efficient butterfly stroke-like soft swimmer. Science Advances 8, eadd3788 (2022).

[29] Zhong, Q. et al. Tunable stiffness enables fast and efficient swimming in fish-like robots. Science Robotics 6, eabe4088 (2021).

[30] Chen, D., Wu, Z., Dong, H., Tan, M. & Yu, J. Exploration of swimming performance for a biomimetic multi-joint robotic fish with a compliant passive joint. Bioinspiration & Biomimetics 16, 026007 (2020).

[31] Zhu, J. et al. Tuna robotics: A high-frequency experimental platform exploring the performance space of swimming fishes. Science Robotics 4, eaax4615 (2019).

[32] White, C. H., Lauder, G. V. & Bart-Smith, H. Tunabot Flex: A tuna-inspired robot with body flexibility improves high-performance swimming. Bioinspiration & Biomimetics 16, 026019 (2021).

[33] Bujard, T., Giorgio-Serchi, F. & Weymouth, G. D. A resonant squid-inspired robot unlocks biological propulsive efficiency. Science Robotics 6, eabd2971 (2021).

[34] Katzschmann, R. K., DelPreto, J., MacCurdy, R. & Rus, D. Exploration of underwater life with an acoustically controlled soft robotic fish. Science Robotics 3, eaar3449 (2018).

[35] Chen, B. & Jiang, H. Swimming performance of a tensegrity robotic fish. Soft robotics 6, 520-531 (2019).

[36] Liu, S., Liu, C., Liang, Y., Ren, L. & Ren, L. Tunable Stiffness Caudal Peduncle Leads to Higher Swimming Speed without Extra Energy. IEEE Robotics and Automation Letters (2023).

[37] Chen, B. & Jiang, H. Body stiffness variation of a tensegrity robotic fish using antagonistic stiffness in a kinematically singular configuration. IEEE Transactions on Robotics 37, 1712-1727 (2021).

[38] Zhong, Y., Li, Z. & Du, R. A novel robot fish with wire-driven active body and compliant tail. IEEE/ASME Transactions on Mechatronics 22, 1633-1643 (2017).

[39] Liao, X., Zhou, C., Zou, Q., Wang, J. & Lu, B. Dynamic Modeling and Performance Analysis for a Wire-Driven Elastic Robotic Fish. IEEE Robotics and Automation Letters 7, 11174-11181 (2022).

[40] Ng, T. J., Chen, N. & Zhang, F. Snapp: An Agile Robotic Fish with 3-D Maneuverability for Open Water Swim. IEEE Robotics and Automation Letters (2023).

[41] Chen, D., Wu, Z., Meng, Y., Tan, M. & Yu, J. Development of a high-speed swimming robot with the capability of fish-like leaping. IEEE/ASME Transactions on Mechatronics 27, 3579-3589 (2022).

[42] Wang, X. et al. Toward Propulsive Performance Evaluation of a Robotic Tuna Based on the Damping-Elastic Composite Mechanism. IEEE/ASME Transactions on Mechatronics (2023).

[43] Liao, X., Zhou, C., Wang, J. & Tan, M. A Wire-Driven Dual Elastic Fishtail With Energy Storing and Passive Flexibility. IEEE/ASME Transactions on Mechatronics (2023).

[44] Du, S., Wu, Z., Wang, J., Qi, S. & Yu, J. Design and control of a two-motor-actuated tuna-inspired robot system. IEEE Transactions on Systems, Man, and Cybernetics: Systems 51, 4670-4680 (2019).

[45] Videler, J. & Wardle, C. Fish swimming stride by stride: speed limits and endurance. Reviews in Fish Biology and Fisheries 1, 23-40 (1991).

[46] Kopman, V. & Porfiri, M. Design, modeling, and characterization of a miniature robotic fish for research and education in biomimetics and bioinspiration. IEEE/ASME Transactions on mechatronics 18, 471-483 (2012).

[47] Ma, F. & Chen, G. Modeling large planar deflections of flexible beams in compliant mechanisms using chained beam-constraint-model. Journal of Mechanisms and Robotics 8, 021018 (2016).

SUMMARY OF INVENTION

Accordingly, the present invention, in one aspect, is a device for providing propulsion in water. The device includes an elongated elastic member that has a fixed end and a free end, a parallel linkage mechanism that has a first link and a second link, and a propelling member connected to the free end of the elongated elastic member. A first end of the first link is fixedly located relative to the fixed end of the elongated elastic member. The first end of the first link is adapted to pivot by a first servo motor. A first end of the second link is fixedly located relative to the fixed end of the elongated elastic member. The first end of the second link is adapted to pivot by a second servo motor. A second end of the first link and a second end of the second link are pivotally connected to each other, as well as to the free end of the elongated elastic member, to form a passive rotational joint. A motion of the propelling member is determined by a moving trajectory of the passive rotational joint.

In some embodiments, the first link includes a first driving member, and a first driven member pivotally connected to the first driving member. The first end of the first link is an end of the first driving member away from the first driven member. The second end of the first link is an end of the first driven member away from the first driving member. The second link includes a second driving member, and a second driven member pivotally connected to the second driving member. The first end of the second link is an end of the second driving member away from the second driven member. The second end of the second link is an end of the second driven member away from the second driving member.

In some embodiments, a projection of the first driving member on a plane to which a pivoting axis of the passive rotational joint is normal, and a projection of the second driving member on the plane, cross each other to form a X shape.

In some embodiments, the first driven member and the second driven member each have a concave shape. The concave shapes of the first driven member and the second driven member face each other.

In some embodiments, the device further includes a controller coupled to the first servo motor and the second servo motor, and configured to actuate the first servo motor and the second servo motor according to a predetermined pattern.

In some embodiments, the predetermined pattern is derived from an inverse kinematics of the parallel linkage mechanism.

In some embodiments, the motion of the propelling member is adapted to be switched between a monostable mode and a bistable mode.

In some embodiments, the parallel linkage mechanism further contains a third link and a fourth link. The third link is parallel to and adapted to move in synchronization with the first link. The fourth link is parallel to and adapted to move in synchronization with the second link.

In some embodiments, the device is included in a robotic fish. The elongated elastic member is an elastic spine of the robotic fish. The propelling member is a compliant caudal fin.

In some embodiments, the device further includes a housing. The fixed end of the elongated elastic member, the first servo motor and the second servo motor are mounted on the housing.

In some embodiments, the first end of the first link and the first end of the second link are symmetrically located about a virtual line that passes through the fixed end of the elongated elastic member.

In some embodiments, the propelling member is configured to provide a turning force to a submersible robot.

In some embodiments, the propelling member is configured to provide a locomotion force to a submersible robot.

In some embodiments, the elongated elastic member has a strip shape.

In some embodiments, the passive rotational joint contains a housing, a shaft rotatably received within the housing, and a bearing connected between the shaft and the housing. The housing is connected to the elongated elastic member and the propelling member. The shaft is fixedly connected to one of the first link and the second link, and rotatably connected to the other one of the first link and the second link.

According to another aspect of the invention, there is provided a robotic fish, which includes a head comprising a housing, a battery received within the housing, a controller received with the housing, an elastic spine comprising a fixed end mounted to the housing and a free end, a complaint caudal fin connected to the free end of the elastic spine, and a parallel linkage mechanism comprising a first link and a second link. A first end of the first link is pivotally connected to the housing. The first end of the first link is adapted to pivot by a first servo motor secured to the housing. A first end of the second link is pivotally connected to the housing. The first end of the second link is adapted to pivot by a second servo motor secured to the housing. The first and second servo motors are adapted to be driven by the controller. A second end of the first link and a second end of the second link are pivotally connected to each other, as well as to the free end of the elastic spine, to form a passive rotational joint. A motion of the caudal fin is determined by a moving trajectory of the passive rotational joint.

One can see that embodiments of the invention therefore provide a realization of a highly flexible and controllable bistable nonlinear mechanism as a "fishtail". The mechanism combines an elastic spine and a lightweight parallel linkage mechanism. Through active control of the endpoint of the elastic spine, the compliant tail can be empowered with exceptional controllability and tunable bi-stability for a much more efficient and also the first-ever accurately controlled bistable elastic propulsion system.

The foregoing summary is neither intended to define the invention of the application, which is measured by the claims, nor is it intended to be limiting as to the scope of the invention in any way.

BRIEF DESCRIPTION OF FIGURES

The foregoing and further features of the present invention will be apparent from the following description of embodiments which are provided by way of example only in connection with the accompanying figures, of which.

DETAILED DESCRIPTION

FIGS. 1*a*-1*d* show a robotic fish according to a first embodiment of the invention, which contains a device for providing propulsion in water for the robotic fish. In general, the device includes a high-efficiency fishtail designed through nonlinear bi-stable mechanism. The nonlinear bi-stable mechanism can be accurately controlled with high output torque and high energy efficiency, with its speed, frequency and amplitude being controllable. As a result, the bi-stable mechanism can be used as fishtail to provide propulsion force of underwater robots.

In particular, the robotic fish has a general appearance that resembles a real fish, and contains a rigid head that is delimited by a housing 20. The housing 20 has a substantially round tip at its front end. Herein the front-back direction is defined as the general direction from the head of the robotic fish to its tail. On top of the housing 20 near the front end, there is configured an antenna 22 that generally point upwards when the robotic fish is immersed in water, and the antenna 22 is configured for transmitting robot information such as sensor data to an external device (e.g., that of the operator), or receiving real-time control commands from the external device. On the left and right sides of the housing 20, there are formed respectively a pair of stabilizer fins 20*a* which are configured to stabilize the robotic system as the head moves through a fluidic medium such as water. Inside the housing 20, there are received necessary electronic components as well as energy source(s) for the robotic fish to properly function, which will be described briefly below.

Figure 1A:
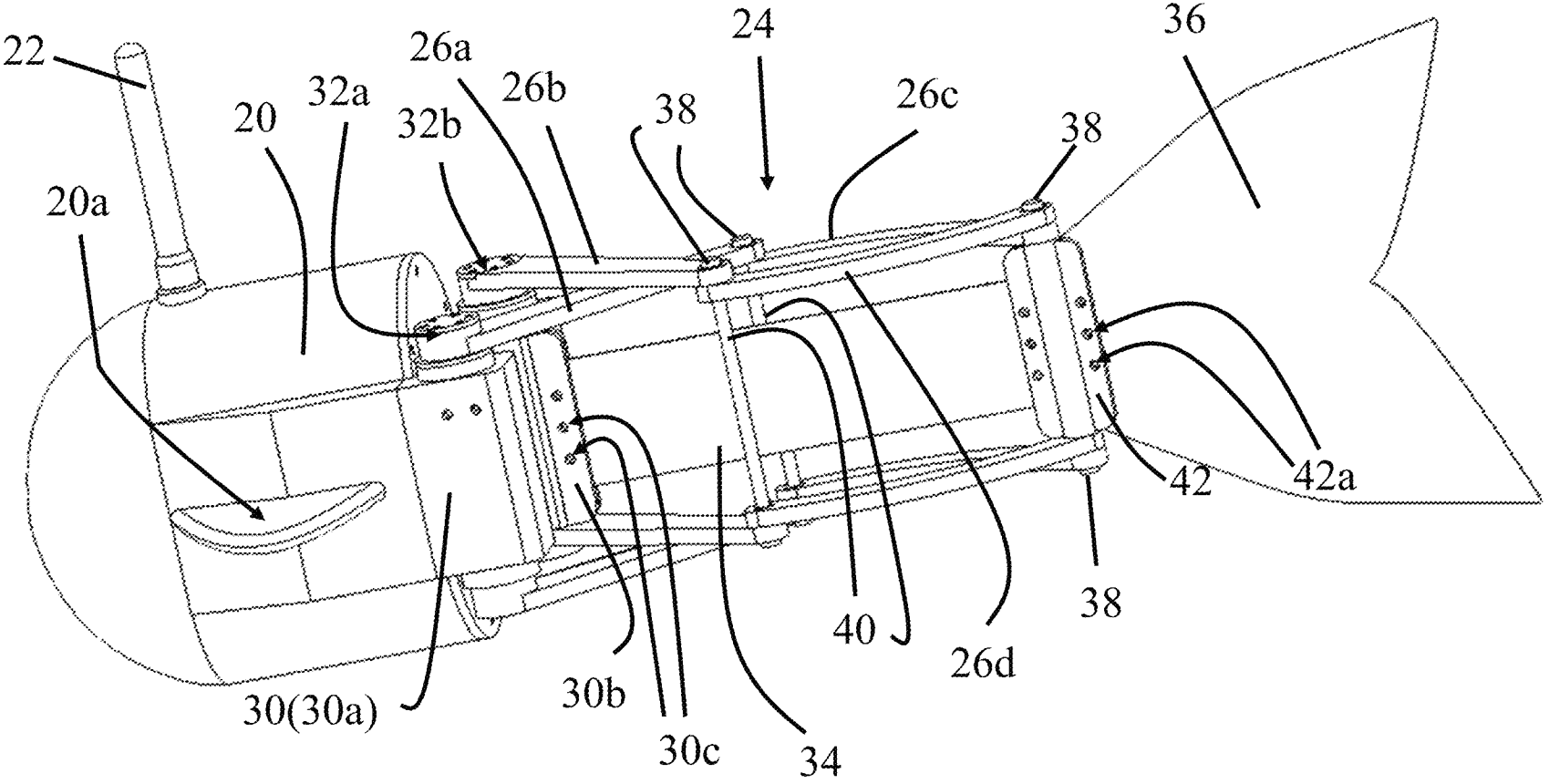
FIG. 1*a* is a left top perspective view of a robotic fish according to a first embodiment of the invention.
Figure 1B:
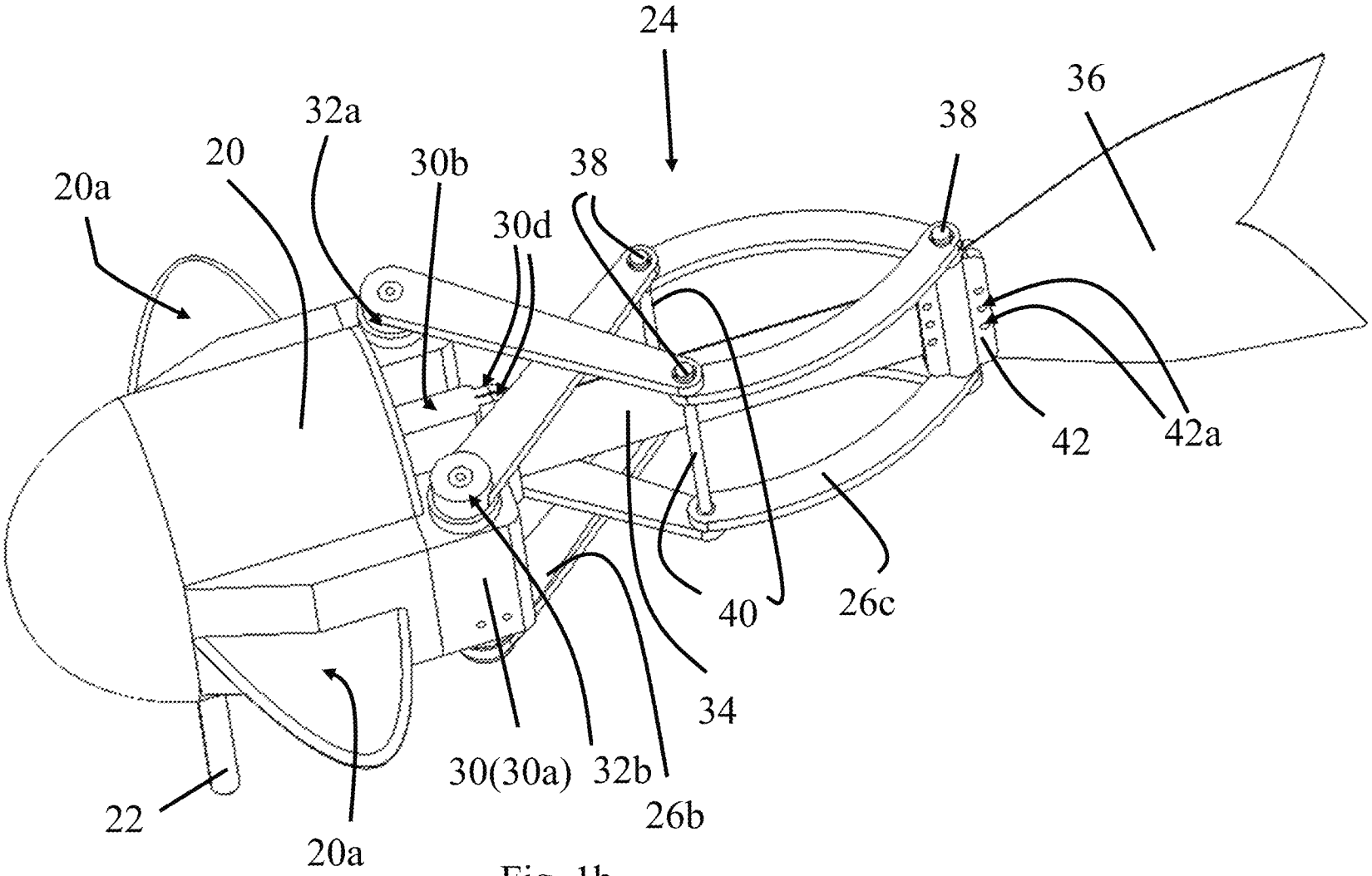
FIG. 1*b* is a right bottom perspective view of the robotic fish in FIG. 1*a*.
Figure 1C:
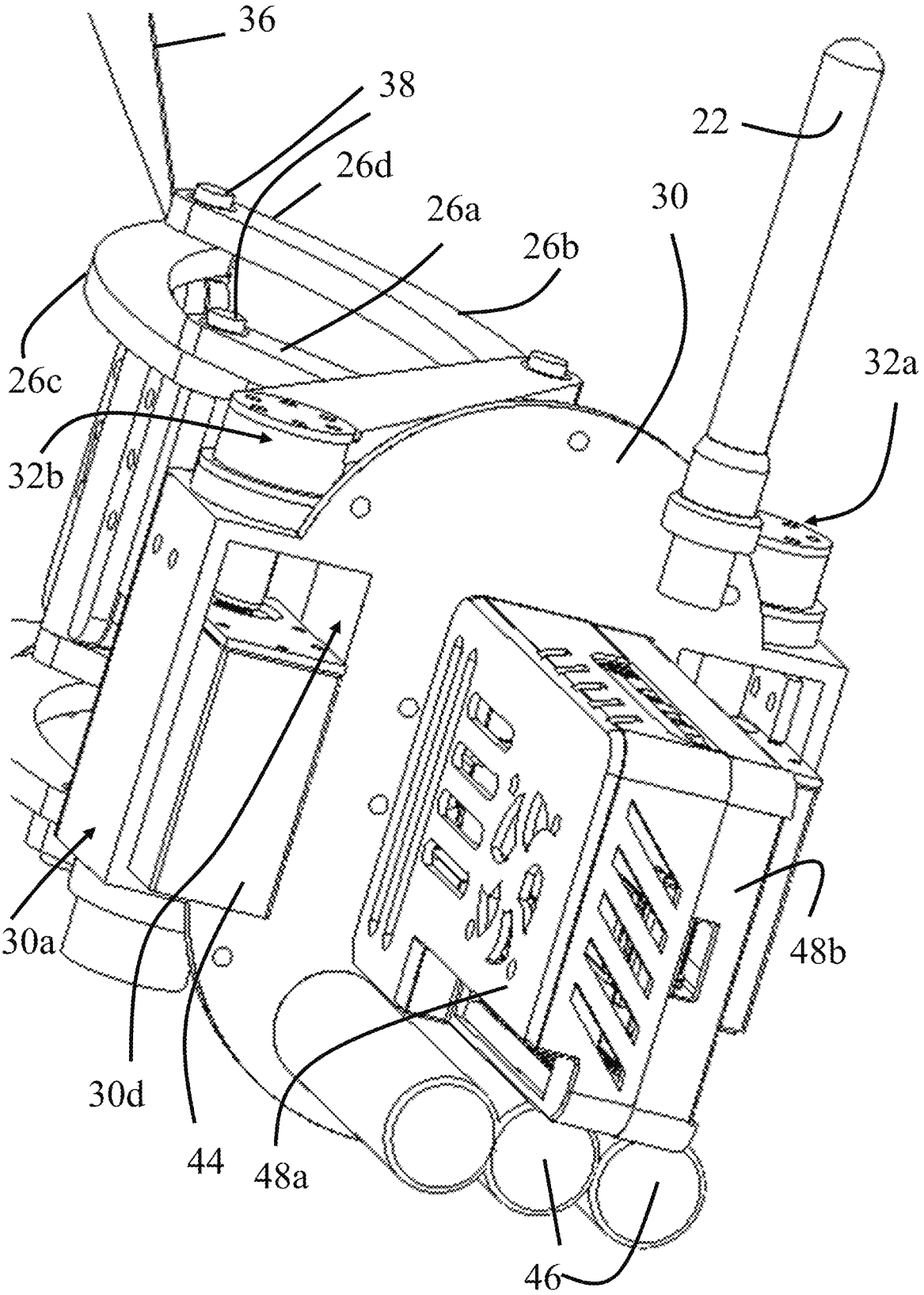
FIG. 1*c* shows a perspective view of the robotic fish in FIG. 1*a* when looking from the front right direction at the robotic fish, where the housing of the head is omitted.

Behind the housing 20 there is an end cap 30 which serves a support for two servo motors 44 each of which is received in a cavity 30*a* formed by an enlarged portion 30*a* on left and right sides of the end cap 30. The enlarged portions 30*a* each has a substantially cuboid shape since the form factor of each servo motors 44 in this example as shown in FIG. 1*c* has a cuboid shape. The remaining part of the end cap 30 beside the enlarged portions 30*a* has a substantially disk shape. The end cap 30 together with the housing 20 form waterproof container that provides a sealed interior space for accommodating the above-mentioned electronic components and energy source(s), for example by using silicon rubber as sealant. In one implementation both the housing 20 and the end cap 30 may be made by ABS (Acrylonitrile Butadiene Styrene) plastic. Between the two enlarged portions 30*a*, there is configured a clamp 30*b* which contains two tabs 30*d* (as best shown in FIG. 1*b*) that are formed a number of through holes 30*c* aligned along the vertical direction. The through holes 30*c* are adapted to align and match with those on a fixed end of an elastic spine 34 which is an elongated elastic member. With the use of fasteners (not shown) like bolts, the fixed end of the elastic spine 34 can be securely clamped between the tabs 30*d*, and is therefore fixedly connected to the end cap 30. Consequently, the fixed end of the elastic spine 34 as well as the two servo motors 44 are all mounted on the end cap 30.

The elastic spine 34 has a strip shape with the two sides of the strip shape facing generally horizontal directions. The elastic spine 34 has a small thickness while its dimension along the vertical direction is much larger. In one implementation the elastic spine 34 is made of a steel strip. A free end of the elastic spine 34 is connected to a caudal fin 36 via a clamp 42. Similar to the clamp 30*b*, the clamp 42 near the tail of the robotic fish has double-tab structures for clamping, with the aid of a number of through holes 42*a*. However, as shown in FIGS. 1*a*-1*b* both sides of the clamp 42 are designed for clamping, so there are two columns of such through holes 42*a* configured on each of the sides of the clamp 42 respectively. On the side of the clamp 42 facing the head of the robotic fish, the clamp 42 is connected to the free end of the elastic spine 34. On the other side of the clamp 42 facing generally backward, the clamp 42 is connected to the caudal fin 36. In this way, movement of the free end of the elastic spine 34 in water will cause the caudal fin 36 to move as well. It should be noted that there is no pivoting allowed for the free end the elastic spine 34 relative to the clamp 42, and for the end of the caudal fin 36 that is connected to the clamp 42 relative to the clamp 42. The clamp 42 is further pivotally connected to a free end of the parallel linkage mechanism, as will be described in more details later.

The caudal fin 36 has the general appearance that resembles a fish tail, and in one implementation it is made of carbon fiber. Both the caudal fin 36 and the elastic spine 34 are complaint members which are not directly driven by mechanical power sources which in this embodiment are the two servo motors 44. Rather, it is because of the parallel linkage mechanism that conveys the mechanical driving force from the two servo motors 44 to the elastic spine 34 and to the caudal fin 36, that allows the robotic fish to swim and turn with different predefined tail beat trajectories.

The parallel link age mechanism, as its name suggests, contains two identical sets of linkages. Taking the top set of linkages (which is closer to the antenna 22) for example, a first link and a second link extend generally in parallel with each other from the head (and in particular, from the end cap 30) to the tail (that is the caudal fin 36). The first link contains two pivotally connected bars 26*a*, 26*c*, and similarly the second link contains two pivotally connected bars 26*b*, 26*d*. The bars 26*a*, 26*b* are respectively connected to a first active rotational joint 32*a* and a second active rotational joint 32*b* and are adapted to be directly driven by the respective servo motors 44 via the first active rotational joint 32*a* or the second active rotational joint 32*b*. In particular, the bar 26*a* is adapted to pivot about an axis (not shown) that is defined by a motor shaft (not shown) of its corresponding servo motor 44. The same applies to the bar 26*b*. As such, the bars 26*a*, 26*b* are referred as a first driving member and a second driving member respectively in this embodiment. The first end of the first link, which is the fixed end of the bar 26*a*, is fixedly located relative to the fixed end of the elastic spine 34, so that even if the bar 26*a* pivots as it is driven by its corresponding servo motor 44, the location of the fixed end of the bar 26*a* that is coupled to the first active rotational joint 32*a* in relation to the fixed end of the elastic spine 34 is always the same. The same applies to the first end of the second link, which is the fixed end of the bar 26*b*.

As shown in FIG. 1*b*, the clamp 30*b* to which the fixed end of the elastic spine 34 is connected to is located between the first and second active rotational joint 32*a*, 32*b* and being equidistant to the latter. In other words, the fixed ends of the first and second links are symmetrically located about a virtual line (not shown) that passes through the fixed end of the elastic spine 34. Although not shown, each of the first and second active rotational joint 32*a*, 32*b* contains a rotary sealing ring that prevents water leakage into the first and second active rotational joint 32*a*, 32*b* that might damage the servo motors 44 and other electronic components in the housing 20.

Figure 1D:
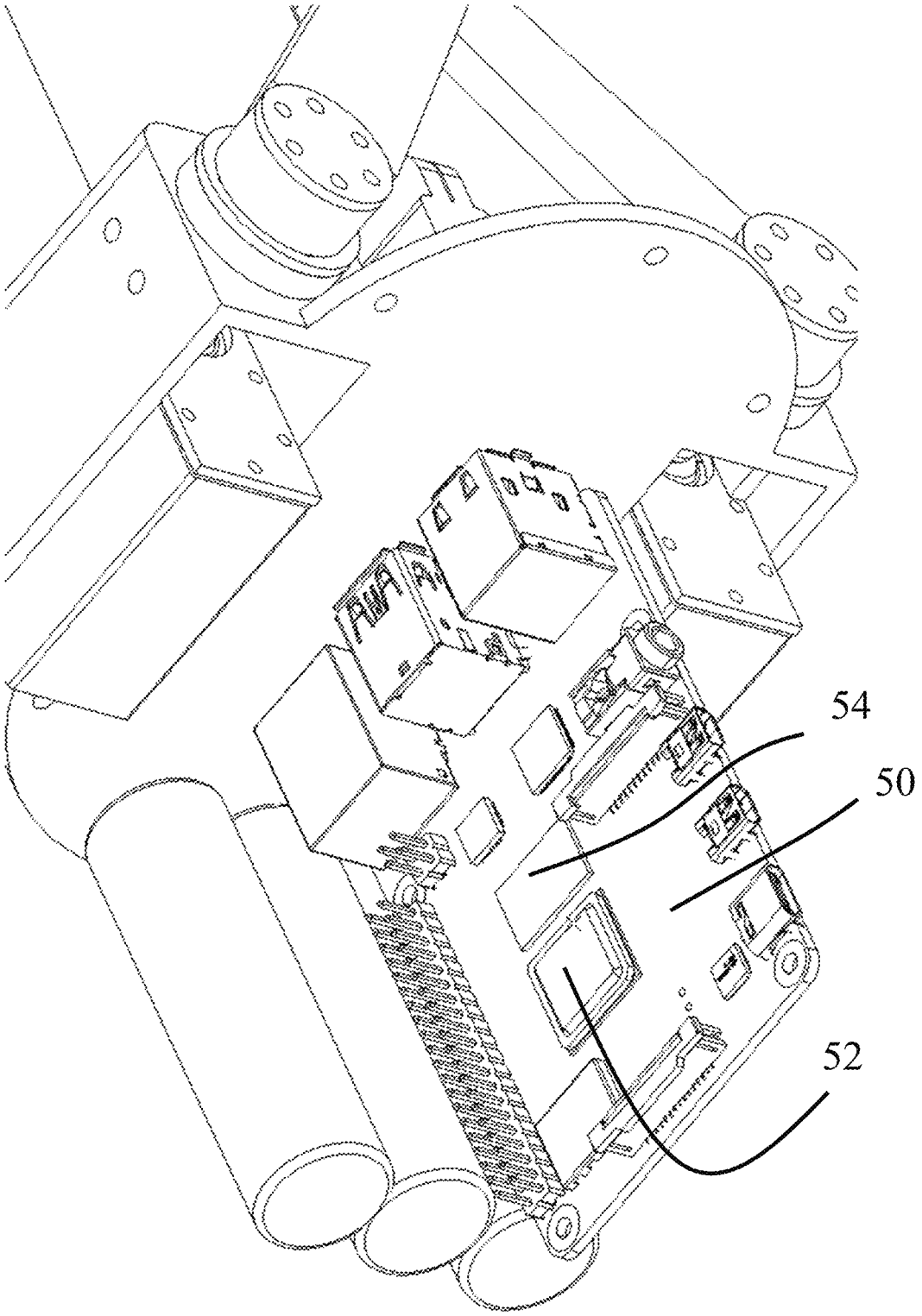
FIG. 1*d* shows a perspective view of the robotic fish in FIG. 1*a* when looking from the front right direction at the robotic fish, where the housing of the head as well as the circuit casing are omitted.
Figure 1E:
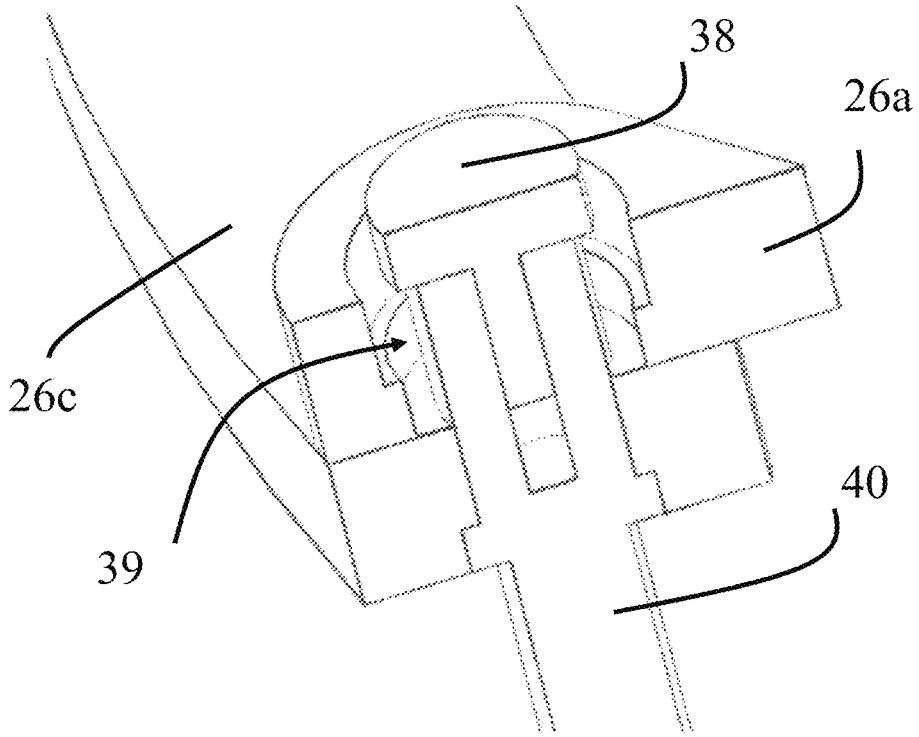
FIG. 1*e* shows a cross-sectional perspective view of a pin joint between two bars in the parallel linkage mechanism in the robotic fish of FIG. 1*a*.

On the other hand, the bars 26*c*, 26*d* are not directly connected to and adapted to be driven by the servo motors 44, but instead they are movable because of their pivotal connections to respectively the bars 26*a*, 26*b* via pin joints. As such, the bars 26*c*, 26*d* are referred as a first driven member and a second driven member respectively in this embodiment. The bar 26*a* and the bar 26*c* are pivotable relative to each other about an axis (not shown) defined by their pin joint, and the same applies to the bar 26*b* and 26*d*. FIG. 1*e* illustrates the internal structure of the pin joint between the bars 26*a*, 26*c*, and the internal structure of the pin joint between the bars 26*b*, 26*d* is identical to it. As shown in FIG. 1*e*, the bar 26*c* at its end close to the bar 26*a* is configured for a shaft 40 of the pin joint to pass through and fixedly connected there. In other words, any rotation of the end of the bar 26*c* around an axis (not shown) of the shaft 40 will cause the shaft 40 to rotate together. On the other hand, the bar 26*a* at its end close to the bar 26*c* is configured with a through hole 39 to allow the shaft 40 to pass through, with a clearance. As such, any rotation of the end of the bar 26*a* around the axis of the shaft 40 will not cause the shaft 40 to rotate together. An end screw 38 is secured to the end of the shaft 40 in FIG. 1*e* to prevent the bar 26*a* from escaping from the loose connection with the shaft 40.

Figure 1F:
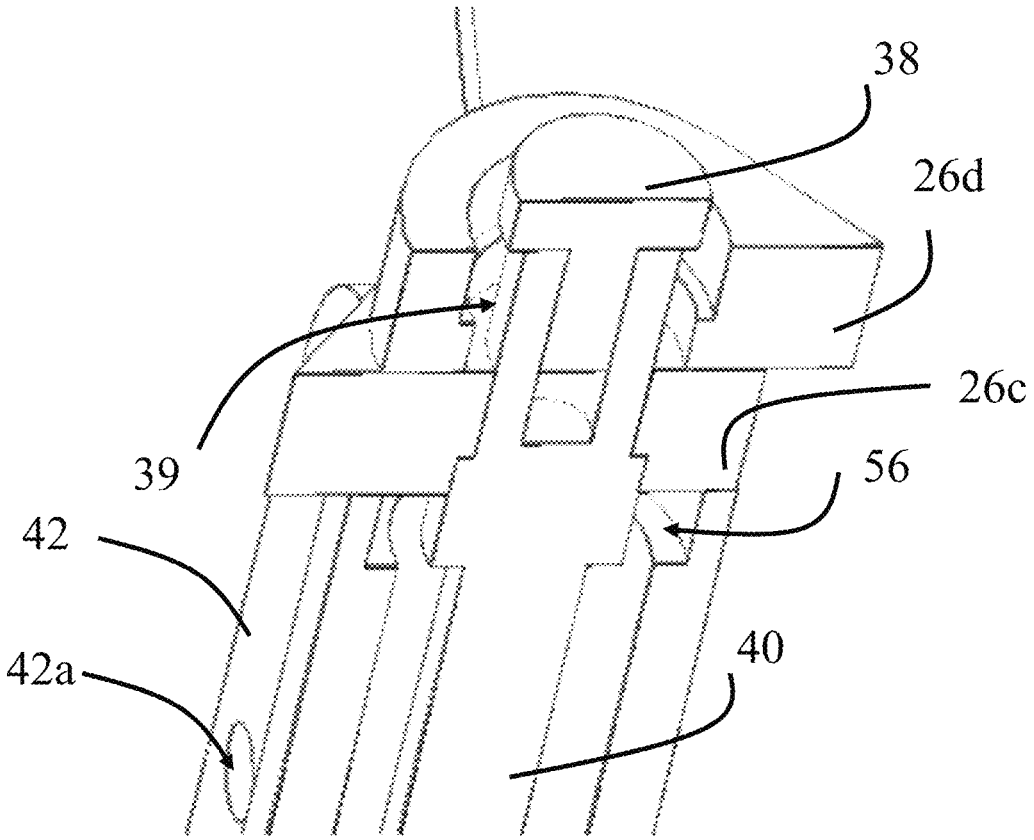
FIG. 1*f* shows a cross-sectional perspective view of passive rotational joint between the parallel linkage mechanism, the elastic spine and the caudal fin in the robotic fish of FIG. 1*a*.

As mentioned above, the free end of the parallel linkage mechanism is pivotally connected to the clamp 42, and thus to the caudal fin 36 and to the free end of the elastic spine 34, therefore forming a passive rotational joint. In particular, the free end of the first link which is the end of the bar 26*c* away from the bar 26*a*, and the free end of the second link which is the end of the bar 26*d* away from the bar 26*b*, are both rotationally coupled to the clamp 42, and also being pivotally connected to each other. FIG. 1*f* best illustrates the internal structure of the passive rotational joint. Similarly to the structure shown in FIG. 1*e*, in the passive rotational join in FIG. 1*f* a shaft 40 passes through and is fixedly connected to the end of the bar 26*c*. On the other hand, the bar 26*d* at its end is configured with a through hole 39 to allow the shaft 40 to pass through, with a clearance. In turn, any rotation of the end of the bar 26*d* around the axis of the shaft 40 will not cause the shaft 40 to rotate together. An end screw 38 is secured to the end of the shaft 40 in FIG. 1*f* to prevent the bar 26*d* from escaping from the loose connection with the shaft 40. Further away from the end of the shaft 40, there is configured a bearing (not shown) that is received within a circumferential cavity formed by the clamp 42. The bearing allows relative rotation between the clamp 42 and the shaft 40. The clamp 42 acts like a housing for the shaft 40, so that the latter is rotatably received within the housing. As a result, each of the bar 26*c*, 26*d*, and the clamp 42 may pivot about an axis (not shown) of the shaft 40 without interfering with the other two. The elastic spine 34 is actively actuated by the parallel linkage mechanism via the passive rotational joint, and in turn the caudal fin 36 is caused to move by the elastic spine 34. The motion of the caudal fin 36 is determined by a moving trajectory of the passive rotational joint.

It should be noted that the parallel linkage mechanism in the robotic fish as shown in FIGS. 1*a*-1*f* has a double-layer crossed structure. In particular, as best shown in FIG. 1*b*, there are two sets of linkages in the parallel linkage mechanism as mentioned above, with the first link and the second link that contain the bars 26*a*-26*d* being the first set. There is another set of linkages with identical structures (i.e., with also four bars configured in the same manner) that is parallel to the first set and separated therefrom. For the sake of brevity only the top set containing the first link and second link that is closer to the antenna 22 has been described in details above. Each set of linkages contains four bars, such as bars 26*a*-26*d* described above. The two sets are parallel to each other and are separated from each other along the vertical direction. In addition, the relative distance between the two sets is generally fixed which is defined by the length of the shafts 40. Also because of the shafts 40, and the fact that each servo motor 44 drives the two parallel bars (e.g., bar 26*a* and its counterpart) at the same time, the motions of the two sets of linkages are always in synchronization. For instance, the pivoting and motion of the bar 26*a* is always in synchronization with its counterpart that is located near the bottom side of the housing 20. In addition, within each set, the bar 20*a* and the bar 20*b* have their projections on a horizontal plane (for example a plane defined by the two stabilizer fins 20*a*) cross each other and form an "X" shape, whereas the bar 20*c* and the bar 20*d* each have a concave shape, and that the concave shapes of the bar 20*c* and the bar 20*d* face each other, so that as the bar 20*c* and the bar 20*d* extend toward the caudal fin 36 their free ends proximate each other and eventually contact each other at the passive rotational joint. In one implementation, all the bars in the parallel linkage mechanism are made of carbon fiber.

The terms "free end" and "fixed end" used to describe the parallel linkage mechanism, or its parts, and the elastic spine 34, are intended to describe the relative freedom of movement as compared between the two ends. A fixed end does not necessarily mean that the end of the corresponding component is not movable at all. Rather, in the example of the bar 26*a* its fixed end is still able to rotate, causing a pivoting movement of the bar 26*a*. It is just that the fixed end of the bar 26*a* is not able to be displaced from other components including the housing 20. In comparison, a free end means that both a pivoting movement and a spatial displacement are possible for the end, for example in the case of the ends of the bars 26*c*, 26*d* that are connected to the passive rotational joint.

In FIG. 1*c*, the internal structure of the fish head of the robotic fish is shown with the housing 20 omitted from the drawing. There are a number of battery cells 46 that are located within the sealed space of the head and at a lower part thereof, which are to power the servo motors 44. The lower location of the battery cells 46 controls the center of gravity of the head so that the robotic fish could more easily create a gesture equilibrium in water. There is another battery cell (not shown) in the head for powering the control circuits. The control circuits are located within a circuit casing that consists by half casings 48*a*, 48*b*. As shown in FIG. 1*c* the circuit casing is vertically orientated and is located above the battery cells 46. In FIG. 1*d*, the circuit casing is omitted, and one can see that a circuit board 50 is provided with various I/O ports provided thereon, as well as a controller 52 and a memory 54. The controller 52 is adapted to actuate the two servo motors 44 according to their respective predetermined patterns, as will be described in more detail below. There are also current sensors (not shown) configured for measuring working currents of the servo motors 44 and for providing the sensed data to the controller 52. In one implementation, the circuit board 50) is a Raspberry Pi 4 board (https://www.raspberrypi.com/products/raspberry-pi-4-model-b/) with the controller 52 and a memory 54 directly provided by the Raspberry Pi 4 board.

Figure 2A:
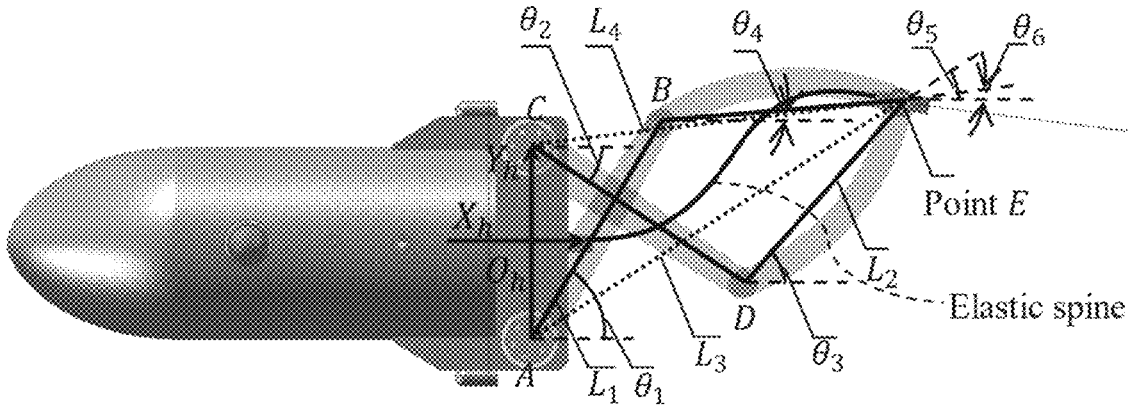
FIG. 2*a* illustrates defined parameters for the kinematics of parallel linkage mechanism in the robotic fish of FIGS. 1*a*-1*f*.
Figure 2B:
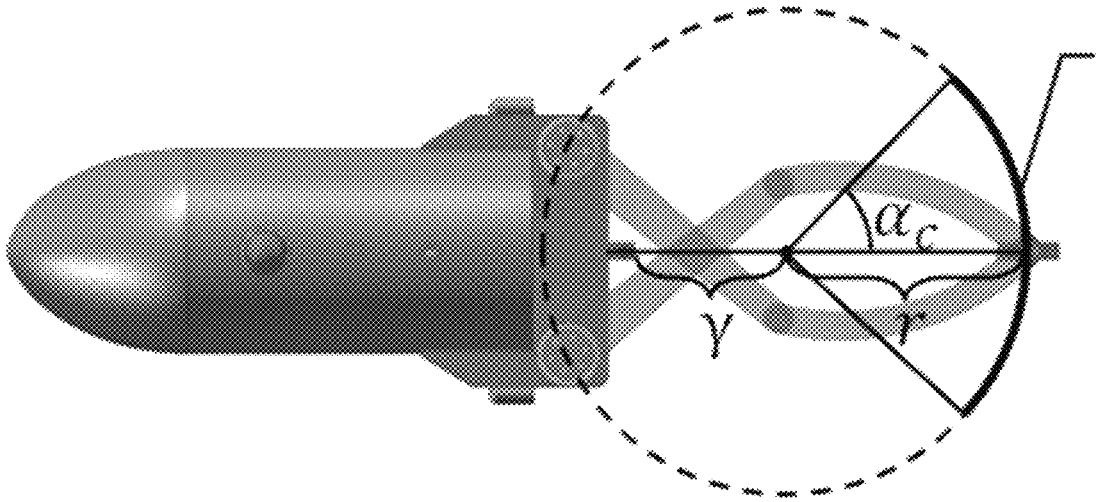
FIG. 2*b* illustrates the tail beat trajectory defined by three parameters ($\gamma$, r, and $\alpha_c$) of the monostable mode for the robotic fish of FIGS. 1*a*-1*f*.
Figure 2C:
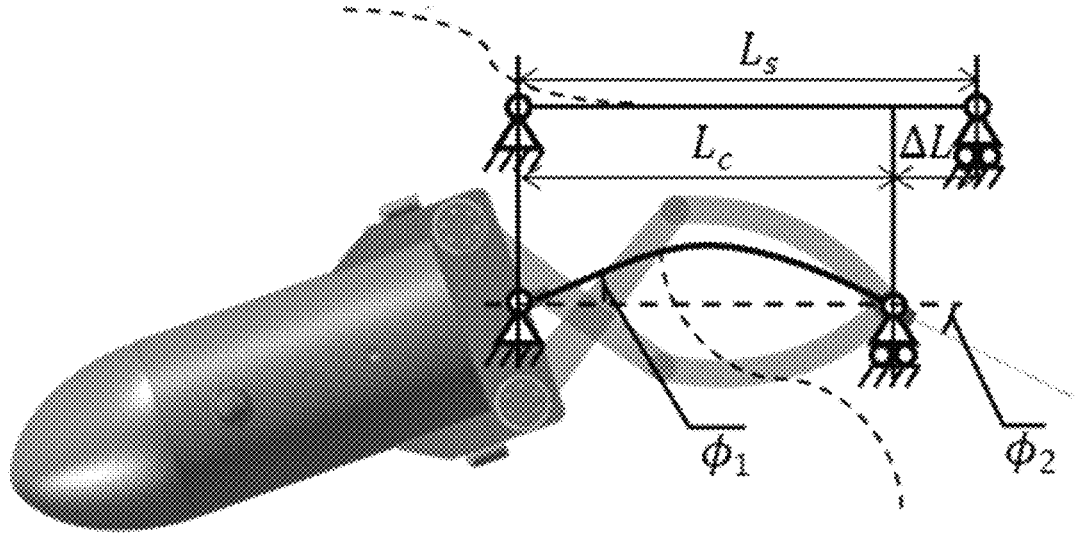
FIG. 2*c* illustrates parameters used to derive the tail beat trajectory of the bistable mode for the robotic fish of FIGS. 1*a*-1*f*.

Having described the components and other structural features of the robotic fish in FIGS. 1*a*-1*f*, the description will now go to the working principle of the robotic fish. Through the accurate trajectory control of the endpoint (that is, the free end) of the elastic spine 34 through the parallel linkage mechanism, the tail (i.e., the caudal fin 36) possesses tunable bistability, consequently leading to the ability of flexible switching between two different motion modes. More specifically, the robotic fish can perform smooth swing motion of the monostable mode (as shown in FIG. 2*b*) and rapid impulsive motion of the bistable mode (as shown in FIG. 2*c*). With the controllable bistability, the propulsion can demonstrate much better maneuverability in forward and turning speed (referring to FIGS. 7*d* and 10*b*) and exhibit a smaller turning radius (referring to FIG. 10*c*) and lower energy consumption over a wide range of speeds through the motion modes switch (referring to FIG. 7*e*). It is also noted that the continuous morphology of tail allows the robot to steer with a most effective tail beating trajectory, thus further leading to good maneuverability.

Figure 2D:
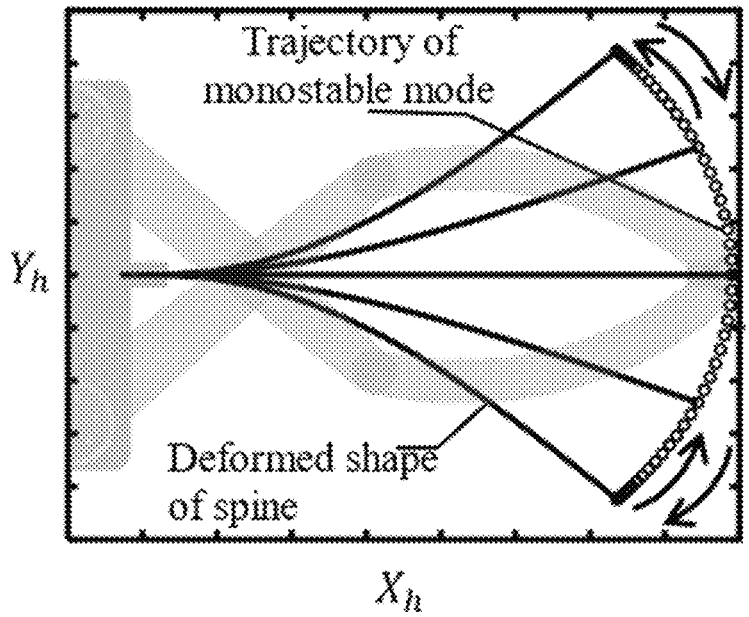
FIG. 2*d* illustrates deformed shapes of the elastic spine in the monostable mode of the robotic fish of FIGS. 1*a*-1*f*.
Figure 2E:
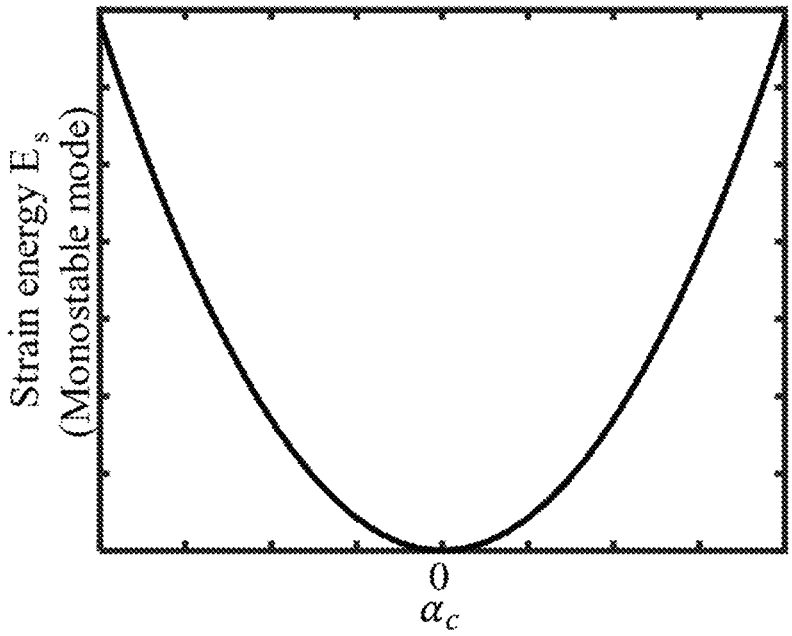
FIG. 2*e* illustrates strain energy of the monostable mode of the robotic fish of FIGS. 1*a*-1*f*.

As mentioned above, through the accurate control of the parallel linkage mechanism, the elastic spine 34 connected to the passive rotational joint can follow any motion trajectories to swing. Based on the predefined trajectory, inverse kinematics can be used to obtain the input of the two servo motors in the active rotational joints 32*a*, 32*b* to control the parallel linkage mechanism, and defined parameters of the parallel linkage mechanism for the derivation of inverse kinematics are shown in FIG. 2*a*. FIG. 2*b* demonstrates the trajectory generation of the monostable mode, which is part of a circle and controlled by three parameters as follows. Here, $\gamma$ is the length between the circle center and the start point of the elastic spine 34. The distance from the circle center to the controlled rotational joint (point E) is the radius of the trajectory, denoted by r. The angle $\alpha_c$ is between the midline of the robot and the radius connected to the endpoint of the trajectory and used to control the tail beat amplitude. The deformed shape of the elastic spine 34 during the motion of the monostable mode is presented in FIG. 2*d*. For each motion cycle of monostable mode, point E passes the point where the elastic spine is in the undeformed state. Hence, the minimum strain energy of the elastic spine is 0 and is located at only one point of the trajectory of the monostable mode as seen in FIG. 2*e*.

The theoretic model of the monostable mode is presented below. The motion of the tail is controlled by the predefined trajectory of the point E to realize different swimming mode. Thus, the inverse kinematics of the parallel mechanism was applied to derive the control laws of two servo motors. The parameters of the structure are prescribed in FIG. 2*a*. The vector loop-closure equations of the parallel mechanism can be obtained as $$\begin{cases} L_3 e^{i\theta_5} = L_1 e^{i\theta_1} + L_2 e^{i\theta_4} \\ L_4 e^{i\theta_6} = L_1 e^{i\theta_2} + L_2 e^{i\theta_3} \end{cases} \tag{1}$$

where $L_3$, $L_4$, $\theta_5$, and $\theta_6$ can be calculated by $$\begin{cases} L_3 = \sqrt{(x_E^h - x_A^h)^2 + (y_E^h - y_A^h)^2} \\ L_4 = \sqrt{(x_E^h - x_C^h)^2 + (y_E^h - y_C^h)^2} \\ \theta_5 = \arctan\dfrac{y_E^h - y_A^h}{x_E^h - x_A^h} \\ \theta_6 = \arctan\dfrac{y_E^h - y_C^h}{x_E^h - x_C^h} \end{cases} \tag{2}$$

By solving equations (1), the control laws of two motors can be obtained as $$\begin{cases} \theta_1 = \left\| \arccos\left(\dfrac{L_3^2 + L_1^2 - L_2^2}{2L_1L_3}\right) \right\| + \theta_5 \\ \theta_2 = -\left\| \arccos\left(\dfrac{L_4^2 + L_1^2 - L_2^2}{2L_1L_4}\right) \right\| + \theta_6 \end{cases} \tag{3}$$

The monostable mode is shown in FIG. 2*b*. To realize this mode, it is required to derive the swinging trajectory for point E of the parallel mechanism first. Based on the defined parameters $\gamma$, r, and $\alpha_c$, the trajectory can be calculated by the following equations.

$$\begin{cases} {}^hX_E = d_1 + \gamma + r\cos\alpha_c \\ {}^hY_E = r\sin\alpha_c \end{cases} \tag{4}$$

where $d_1$ is the distance between the start point of the elastic spine and the origin of the head frame $O_hX_hY_h$.

The rhythmic oscillation of the tail can be controlled by the following equation.

$$\alpha_c = a\sin 2\pi ft + b \tag{5}$$

where a, f, and b are amplitude, frequency, and bias angle, respectively.

Substituting equations (4) and (5) into the equations of the inverse kinematics, the control angles of two motors for the monostable mode can be obtained as shown in equations (3).

Figure 3A:
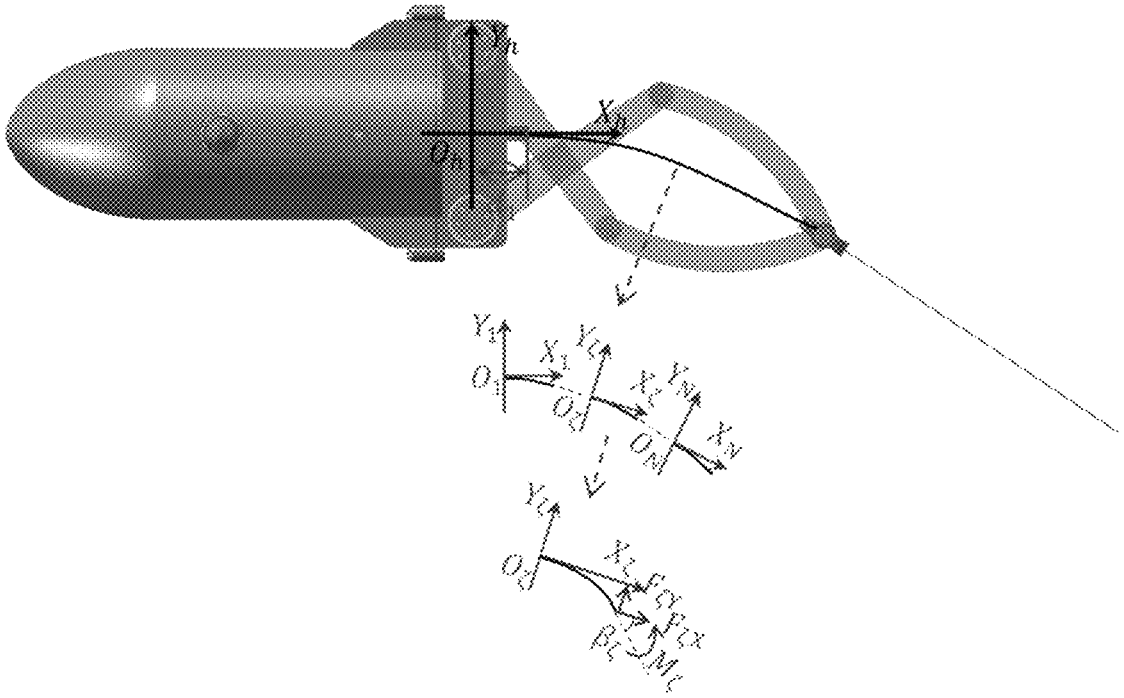
FIG. 3*a* shows coordinate frames for the monostable motion mode of the robotic fish of FIGS. 1*a*-1*f*.

The mathematical model to calculate the deformed shape, strain energy, etc. of the elastic spine for the monostable was derived by the chained beam constraint model (CBCM) [47]. Using the chained beam constraint model, the elastic spine is separated equally into N segments as shown in FIG. 3*a*. Each segment can be assumed as a cantilever beam. And a local coordinate system $O_\zeta X_\zeta Y_\zeta$ is attached the start point of the $\zeta$-th segment. $F_{\zeta X}$, $F_{\zeta Y}$, and $M_\zeta$ are transverse force, axial force, and moment respectively subject to the free end of the $\zeta$-th segment, which results in translation and rotation displacements $X_\zeta$, $Y_\zeta$, and $\beta_\zeta$. And then one can obtain the following equations about the relation between the force and displacement for the elastic spine.

$$\begin{cases} \begin{bmatrix} f_{\zeta y} \\ m_\zeta \end{bmatrix} = R_1 \begin{bmatrix} y_\zeta \\ \beta_\zeta \end{bmatrix} + f_{\zeta x} R_2 \begin{bmatrix} y_\zeta \\ \beta_\zeta \end{bmatrix} + f_{\zeta x}^2 R_3 \begin{bmatrix} y_\zeta \\ \beta_\zeta \end{bmatrix} \\ x_\zeta = \dfrac{t_s^2 f_{\zeta X}}{12} - \dfrac{1}{2}[y_\zeta \;\; \beta_\zeta] R_2 \begin{bmatrix} y_\zeta \\ \beta_\zeta \end{bmatrix} - f_{\zeta x}[y_\zeta \;\; \beta_\zeta] R_3 \begin{bmatrix} y_\zeta \\ \beta_\zeta \end{bmatrix} \end{cases} \tag{6}$$

where all the parameters are normalized as $$t_s = \frac{NT_s}{L_s},\; x_\zeta = \frac{NX_\zeta}{L_s},\; y_\zeta = \frac{NY_\zeta}{L_s},\; f_{\zeta X} = \frac{F_{\zeta X}L_s^2}{N^2EI},\; f_{\zeta Y} = \frac{F_{\zeta Y}L_s^2}{N^2EI},\; m_\zeta = \frac{M_\zeta L_s}{NEI} \tag{7}$$

And $T_s$ is the thickness of the elastic spine. E is the Young's modulus. I is the moment of inertial. $R_1$, $R_2$, and $R_3$ are the matrices of non-dimensional beam characteristic coefficients listed as follows.

$$R_1 = \begin{bmatrix} 12 & -6 \\ -6 & 4 \end{bmatrix}, R_2 = \begin{bmatrix} \frac{6}{5} & -\frac{1}{10} \\ -\frac{1}{10} & \frac{2}{15} \end{bmatrix}, R_3 = \begin{bmatrix} -\frac{1}{700} & \frac{1}{1400} \\ \frac{1}{1400} & -\frac{11}{6300} \end{bmatrix} \tag{8}$$

The strain energy stored in each segment of the deflected spine can be obtained by $$v_\zeta = \frac{1}{2}\frac{t_s^2 f_{\zeta X}^2}{12} + \frac{1}{2}[y_\zeta \;\; \beta_\zeta]R_1\begin{bmatrix} y_\zeta \\ \beta_\zeta \end{bmatrix} - \frac{1}{2}f_{\zeta X}^2[y_\zeta \;\; \beta_\zeta]R_3\begin{bmatrix} y_\zeta \\ \beta_\zeta \end{bmatrix} \tag{9}$$

Then the total strain energy stored in the elastic spine can be calculated by the sum of the strain energy stored in each segment as $$V_s = \sum_1^N \frac{v_\zeta NEI}{L_s} \tag{10}$$

The force equations of the ζ-th segment are expressed as $$\begin{bmatrix} \cos\varphi_\zeta & -\sin\varphi_\zeta \\ \sin\varphi_\zeta & \cos\varphi_\zeta \end{bmatrix}\begin{bmatrix} F_{\zeta X} \\ F_{\zeta Y} \end{bmatrix} = \begin{bmatrix} F_{EX_h} \\ F_{EY_h} \end{bmatrix} \tag{11}$$

where $\varphi_\zeta$ is the angle between the coordinate frame on the ζ-th segment and the coordinate frame on the robot head and is expressed as $$\varphi_\zeta = \sum_{\kappa=1}^{\zeta-1}\beta_k \tag{12}$$

The moment equations of each segment can be derived as $$\begin{cases} M_\zeta = 0, \zeta = N \\ M_\zeta = M_{\zeta-1} - F_{\zeta X}Y_\zeta - F_{\zeta Y}\left(\frac{L_s}{N} + X_\zeta\right), \zeta \neq N \end{cases} \tag{13}$$

Then, one obtain the following displacement equations of the elastic spine in the monostable motion mode.

$$\sum_{\zeta=1}^{N}\left(\begin{bmatrix} \cos\varphi_\zeta & -\sin\varphi_\zeta \\ \sin\varphi_\zeta & \cos\varphi_\zeta \end{bmatrix}\begin{bmatrix} \frac{L_s}{N} + X_\zeta \\ Y_\zeta \end{bmatrix}\right) + \begin{bmatrix} d_1 \\ 0 \end{bmatrix} = \begin{bmatrix} {}^hX_E \\ {}^hY_E \end{bmatrix} \tag{14}$$

The deformed shape of the ζ-th segment of the elastic spine can be calculated by the following equations.

$$y_{s\zeta}(x_{s\zeta}) = \begin{cases} a_1 + a_2x_{s\zeta} + a_3\sin\left(\sqrt{-f_{\zeta x}}\,x_{s\zeta}\right) + a_4\cos\left(\sqrt{-f_{\zeta x}}\,x_{s\zeta}\right), f_{\zeta x} < 0 \\ b_1 + b_2x_{s\zeta} + b_3e^{\sqrt{f_{\zeta x}}\,x_{s\zeta}} + b_4e^{-\sqrt{f_{\zeta x}}\,x_{s\zeta}}, f_{\zeta x} > 0 \\ c_1 + c_2x_{s\zeta} + c_3x_{s\zeta}^2 + c_4x_{s\zeta}^3, f_{\zeta x} = 0 \end{cases} \tag{15}$$

where $x_{s\zeta} \in [0, 1]$. $a_i$, $b_i$, and $c_i$ is the coefficient and can be calculated by substituting the boundary conditions of a cantilever beam into equations (15) as follows.

$$y_{s\zeta}(0) = 0,\; y'_{s\zeta}(0) = 0,\; y_{s\zeta}(1) = y_\zeta,\; y'_{s\zeta}(1) = \beta_\zeta \tag{16}$$

Then the deformed shape of the elastic spine can be obtained by the coordinate transformation between the local coordinate frame and the coordinate frame on the robot head as follows.

$$\begin{bmatrix} {}^hX_{s\zeta} \\ {}^hY_{s\zeta} \end{bmatrix} = \begin{bmatrix} \cos\varphi_\zeta & -\sin\varphi_\zeta \\ \sin\varphi_\zeta & \cos\varphi_\zeta \end{bmatrix}\begin{bmatrix} x_{s\zeta}\left(\frac{L_s}{N} + X_\zeta\right) \\ \frac{y_{s\zeta}L_s}{N} \end{bmatrix} + \begin{bmatrix} {}^hX_{s\zeta 0} \\ {}^hY_{s\zeta 0} \end{bmatrix} \tag{17}$$

where $[{}^hX_{s\zeta 0}\;{}^hY_{s\zeta 0}]^T$ is the coordinate of the start point of each segment in the robot head frame.

Figure 2F:
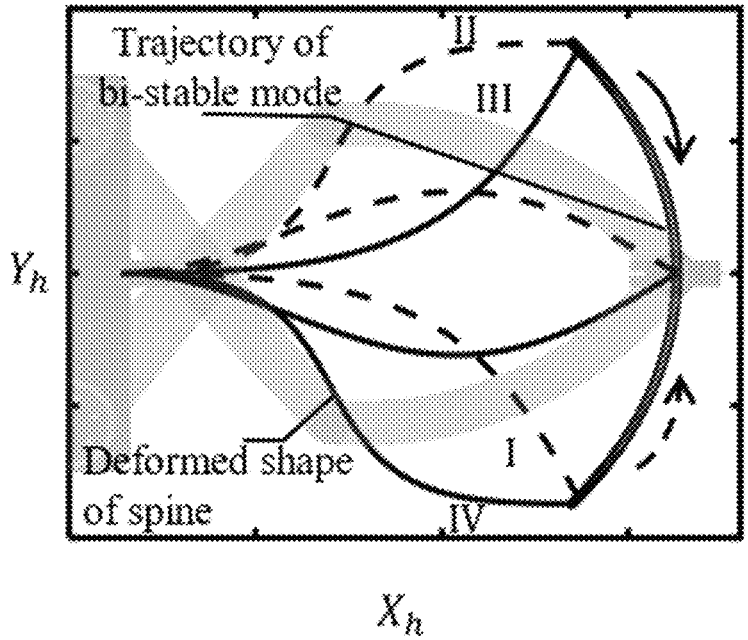
FIG. 2*f* illustrates deformed shapes of the elastic spine in the bistable mode of the robotic fish of FIGS. 1*a*-1*f*.
Figure 2G:
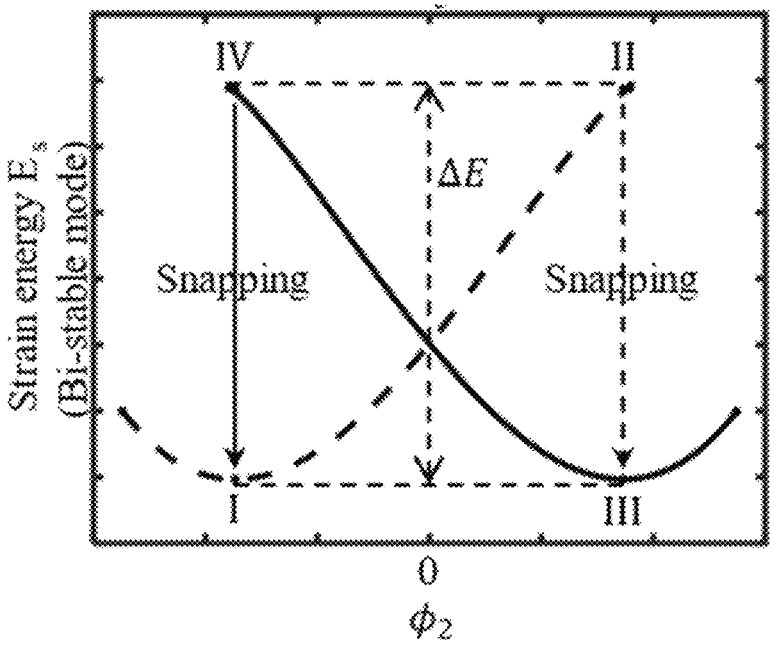
FIG. 2*g* illustrates strain energy of the bistable mode of the robotic fish of FIGS. 1*a*-1*f*.
Figure 2H:
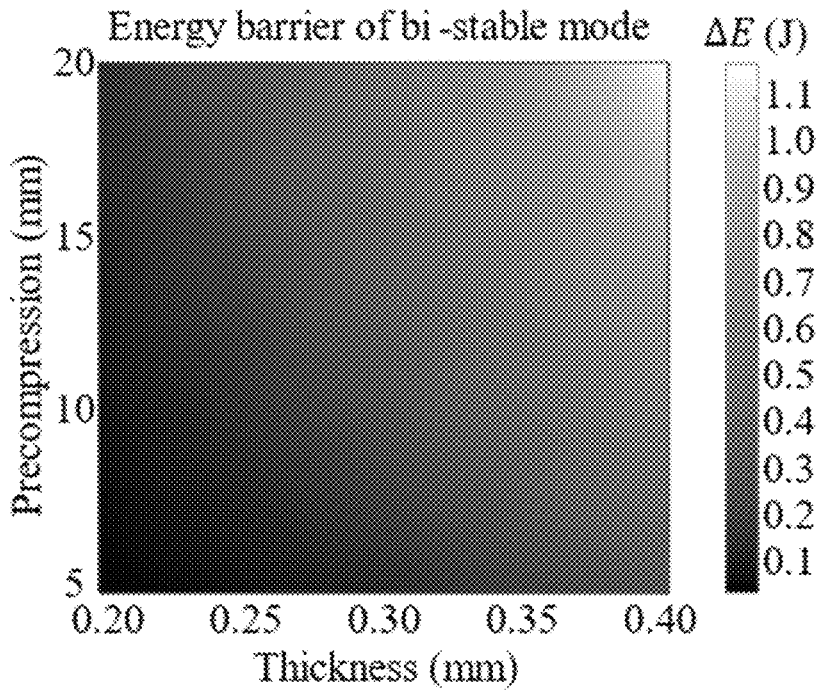
FIG. 2*h* shows different compressions and thicknesses of the elastic spine resulting in different energy barrier ΔE for snapping.

Turning to FIG. 2*c*, which illustrates the realization of the bistable locomotion mode of the robotic fish. In the initial stage of the bistable locomotion mode, there is a prestored strain energy of the elastic spine 34 due to compression (resulting in a pinned-pinned buckled beam). It is known that there are two stable positions of this mechanism, which are symmetrical about the horizontal line. When the input pivot ($\phi_1$ or $\phi_2$) of the elastic spine 34 is actuated by rotation, a phenomenon of instantaneous and rapid change in position and speed i.e., snap-through will be triggered between the switch of two stable states. FIG. 2*f* and FIG. 2*g* show the deformed shape of the elastic spine 34 and its strain energy variation during this process. When the instantaneous and rapid release of the strain energy occurs, the elastic spine snaps from shape II to shape III or from shape IV to shape I. The gap between the maximum energy and the minimum energy is defined as the energy barrier that needs to be overcome to achieve snapping. FIG. 2*h* shows that different precompressions and thicknesses of the elastic spine can lead to different energy barriers.

Figure 3B:
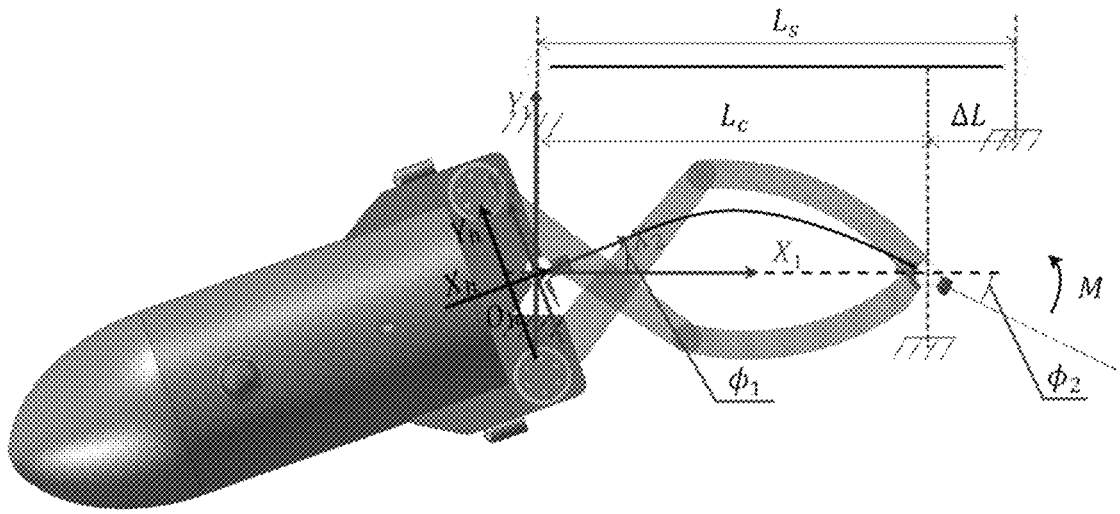
FIG. 3*b* shows coordinate frames for the bistable motion mode of the robotic fish of FIGS. 1*a*-1*f*.

The theory model of the bistable mode of the robotic fish will now be described. In order to get the control trajectory of the bistable locomotion mode, the frames were established as shown in FIG. 3*b*. Through the position and rotation transformations between the frames $O_1X_1Y_1$, $O_2X_2Y_2$, and $O_hX_hY_h$, the trajectory of the bistable mode can be obtained by solving the following equations.

$$\begin{cases} {}^hP_E = {}^hP_2 + {}^2P_E \\ {}^1P_E = {}^1R_2{}^2P_E \end{cases} \tag{18}$$

where ${}^1P_E$, ${}^2P_E$, and ${}^hP_E$ denote the coordinates of the point E in the frames $O_1X_1Y_1$, $O_2X_2Y_2$, and $O_hX_hY_h$, respectively. ${}^hP_2$ is the position vector of the origin of the frame $O_2X_2Y_2$ in the frame $O_hX_hY_h$. ${}^1R_2$ is the rotation matrix between the frames $O_1X_1Y_1$ and $O_2X_2Y_2$. ${}^hP_2$ and ${}^1R_2$ are expressed as $$ {}^hP_2 = \begin{bmatrix} \delta \\ 0 \end{bmatrix}, \ {}^1R_2 = \begin{bmatrix} \cos\phi_1 & -\sin\phi_1 \\ \sin\phi_1 & \cos\phi_1 \end{bmatrix} \tag{19} $$

To obtain the angle $\phi_1$, it is required to derive the theory model of the elastic spine during its movement of bistable mode. As mentioned above, the spine can be regarded as the pinned-pined buckled beam. Thus, the Euler-Bernoulli beam theory can be applied [22]. Then one can get the following equation of the bending moment.

$$ M(\epsilon) = -F_{X_1} Y_1(\epsilon) + F_{Y_1} X_1(\epsilon) \tag{20} $$

where $\epsilon$ is the arclength of the elastic spine.

The motion characteristics of the spine including $\phi_1$, the strain energy, etc., can be derived by equation (20). In particular, $X_1(\epsilon)$ in equation (20) can be linearized in the following form.

$$ X_1(\epsilon) \cong \frac{L_c}{L_s}\epsilon \tag{21} $$

And the boundary conditions of the pinned-pinned beam are expressed as follows.

$$ Y_1(\epsilon = 0) = 0, \ Y_1(\epsilon = L_s) = 0, \ Y_1''(\epsilon = 0) = 0 \tag{22} $$

By substituting equation (21) and the boundary conditions (22) into equation (20), one can obtain the following equation.

$$ Y_1(\epsilon) = Q\left(\sin\left(\frac{aL_s\epsilon}{L_s}\right) - \frac{\sin(aL_s)\,\epsilon}{L_s}\right) \tag{23} $$

where $$ a = \sqrt{\frac{F_{X_1}}{EI}}. $$

and Q can be derived by the precompression length of the elastic spine as follows.

$$ \Delta L = L_s - L_c = \frac{1}{2}\int_0^{L_s} (Y_1')^2 d\epsilon \tag{24} $$

Thus Q can be expressed as $$ Q = \pm 2L_s\sqrt{\frac{\Delta L}{L_s}}\left((aL_s)^2 + aL_s\frac{\sin(2aL_s)}{2} + \cos(2aL_s) - 1\right)^{-\frac{1}{2}} \tag{25} $$

Then one can derive two pivots' angles as $$ \begin{cases} \phi_1 = Y_1'(0) = \dfrac{Q}{L_s}(aL_s - \sin(aL_s)) \\ \phi_2 = Y_1'(L_s) = \dfrac{Q}{L_s}(aL_s\cos(aL_s) - \sin(aL_s)) \end{cases} \tag{26} $$

The strain energy of the elastic spine can be obtained by $$ V_s = \frac{EI}{2}\int_0^{L_s}\left(\frac{d^2Y_1}{d\epsilon^2}\right)d\epsilon = \frac{1}{4}\frac{EI}{L_s}\left(\frac{Q}{L_s}\right)^2(aL_s)^3\left(aL_s - \frac{\sin(2aL_s)}{2}\right) \tag{27} $$

Figure 4A:
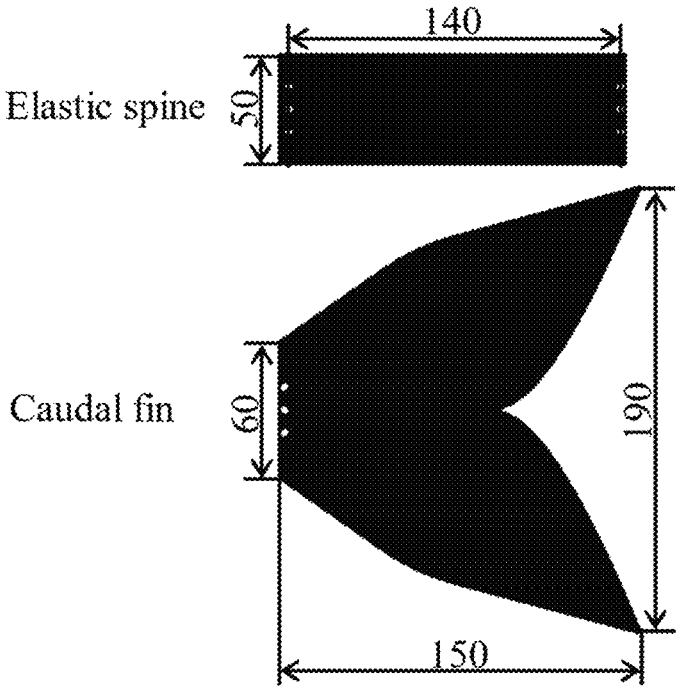
FIG. 4*a* illustrates dimensions of the elastic spine and caudal fin in one exemplary implementation.

The stiffness plays a crucial role in achieving efficient swimming of fish [29], [30]. In the fishtail of the robotic fish in FIGS. 1*a*-1*f*, two compliant elements need to be considered, including the elastic spine 34 and the compliant caudal fin 36. The stiffness of the elastic spine 34 is not only one of the dominant factors on the energy barrier of the bistable locomotion mode but also together with the compliance of the caudal fin 36 determine the kinematics of the tail during swimming. Therefore, the stiffness coordination between the elastic spine 34 and the caudal fin 36 is important for the swimming performance of the robot and its influence is explored for both the monostable and bistable locomotion modes firstly. The stiffness is adjusted by varying the thickness, and other dimensions of the elastic spine and the caudal fin remain unchanged as shown in FIG. 4*a* (unit in mm). The thickness sets of the spine and the caudal fin are {0.25 mm, 0.30 mm, 0.35 mm} and {0.3 mm, 0.4 mm, 0.5 mm} respectively. So, 9 cases in total of thickness combinations for the spine and the caudal fin are tested as presented in FIG. 4*b*. Here, only three cases (SCFC1, SCFC5, and SCFC8) are selected to compare, which represent the best swimming performance for the robot with the elastic spine of three different thicknesses.

Figure 4B:
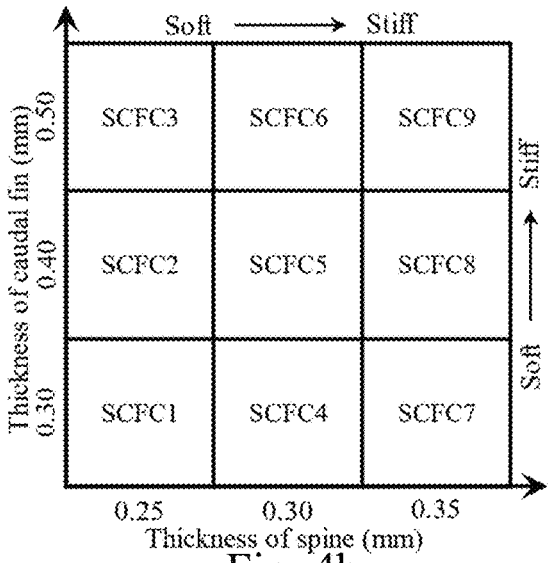
FIG. 4*b* shows different thickness combinations of the elastic spine and caudal fin, in which SCFC is the abbreviation of Spine-Caudal-Fin Combination.
Figure 4C:
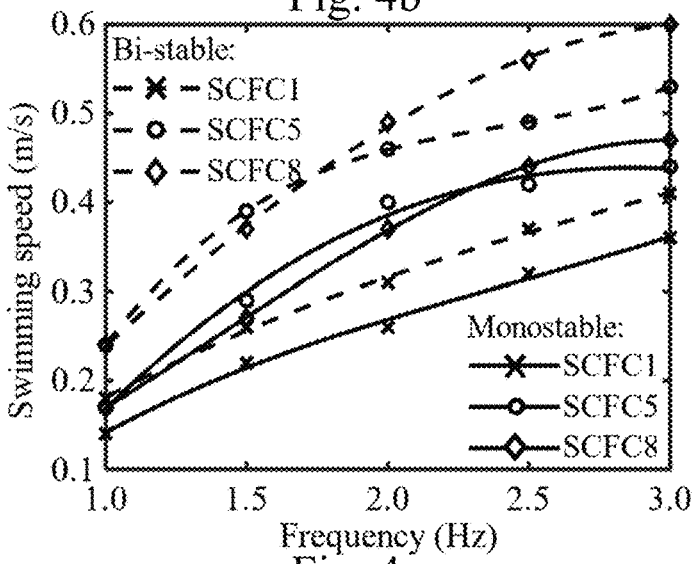
FIG. 4*c* shows the comparison of swimming speed under different frequencies, for three combinations of thicknesses of the elastic spine and the caudal fin.
Figure 4D:
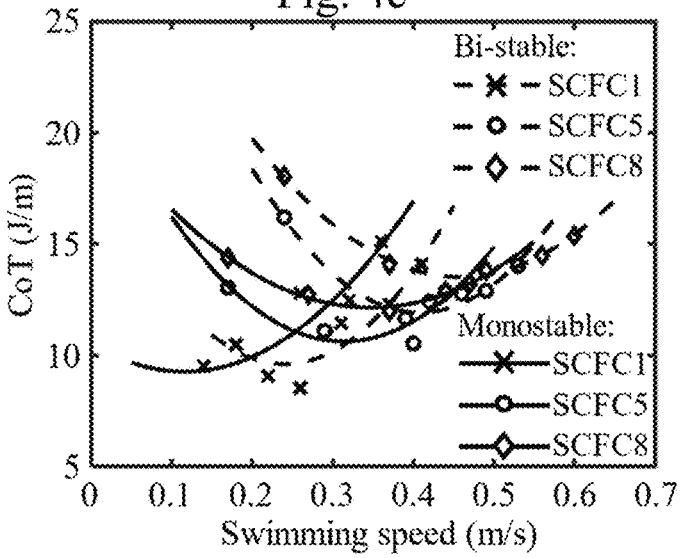
FIG. 4*d* shows the comparison of cost of transport under different frequencies, for the three combinations.

FIG. 4*c* (solid line) and FIG. 4*d* (solid line) demonstrate the results of the average swimming speed and the cost of transport for the monostable mode. The control parameters of the monostable mode are given as $\gamma$=2 cm, $\alpha_c$=40°. And the precompression length of the elastic spine of the bistable mode is set as $\Delta L$=10 mm. CoT is defined as the consumed power for the robot moving over the distance of 1 m, i.e., CoT=P/V [31]. The robot with SCFC1 swims the slowest under different tail beat frequencies. Before the frequency of 2.5 Hz, the robot with SCFC5 is the fastest, however, the speed of the robot with SCFC8 surpasses that of SCFC5 when the frequency rises above 2.5 Hz, and the SCFC8 achieves the highest speed among all cases for the monostable mode at the frequency of 3 Hz. For the results of CoT, no one case is always most energy efficient. When the swimming velocity is under 0.25 m/s, the CoT of the robot with SCFC1 is the lowest. When the speed is in the range between 0.25 m/s and 0.44 m/s, the most energy efficient one turns into SCFC5. And as the speed continues to increase, the best one is SCFC8.

Figure 5A:
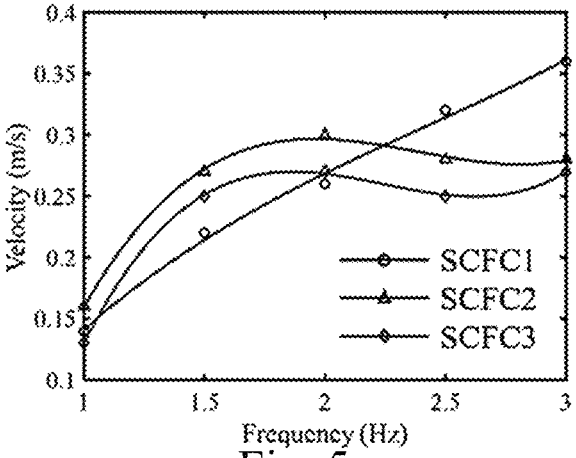
FIG. 5*a* illustrates comparison of the swimming velocity in the frequency domain between the robot with thickness combinations of SCFC1-3 for the monostable swimming mode.
Figure 5B:
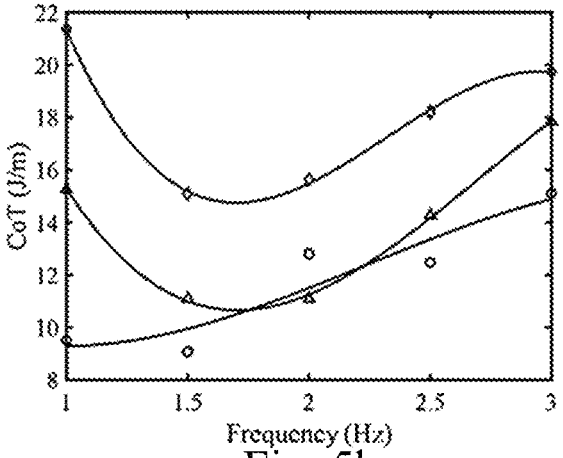
FIG. 5*b* illustrates comparison of the CoT in the frequency domain between the robot with thickness combinations of SCFC1-3 for the monostable swimming mode.
Figure 5C:
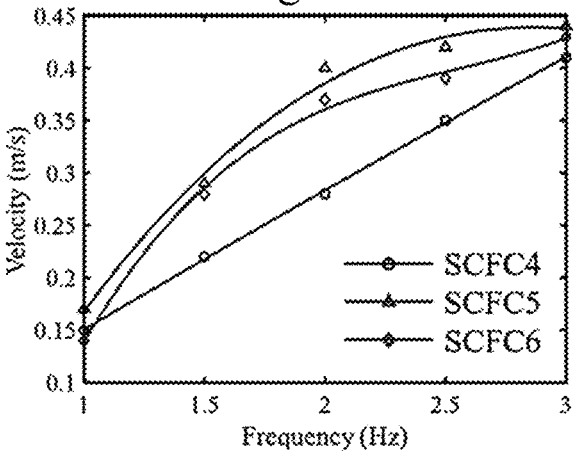
FIG. 5*c* illustrates comparison of the swimming velocity in the frequency domain between the robot with thickness combinations of SCFC4-6 for the monostable swimming mode.
Figure 5D:
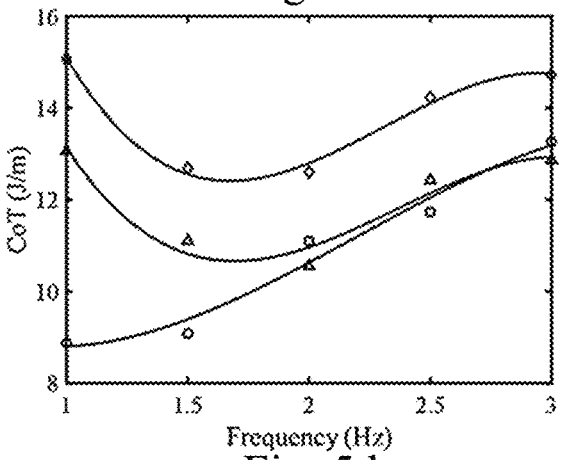
FIG. 5*d* illustrates comparison of the CoT in the frequency domain between the robot with thickness combinations of SCFC4-6 for the monostable swimming mode.
Figure 5E:
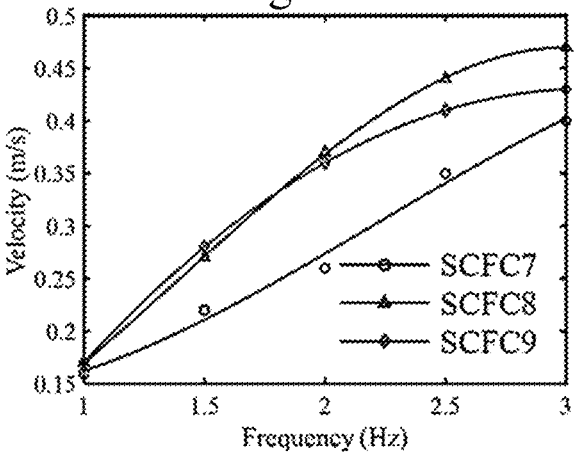
FIG. 5*e* illustrates comparison of the swimming velocity in the frequency domain between the robot with thickness combinations of SCFC7-9 for the monostable swimming mode.
Figure 5F:
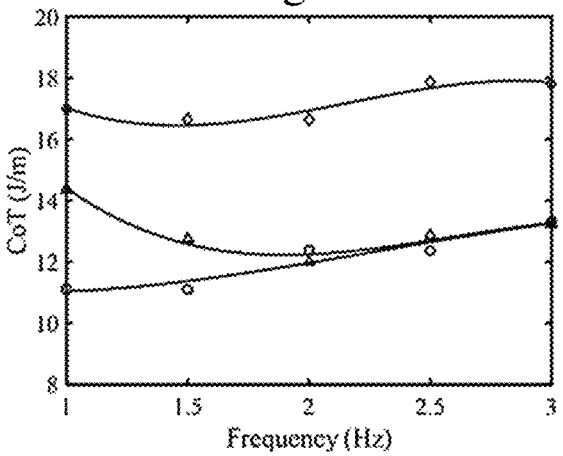
FIG. 5*f* illustrates comparison of the CoT in the frequency domain between the robot with thickness combinations of SCFC7-9 for the monostable swimming mode.

FIGS. 5*a*-5*f* shows further comparison of the swimming velocity and CoT in the frequency domain between the robot with all nine thickness combinations (that are shown in FIG. 4*b*) of the elastic spine and the caudal fin for the monostable swimming mode. In FIGS. 5*a* and 5*b*, the thickness of the spine is 0.25 mm. SCFC1 performs better in velocity and CoT. In FIGS. 5*c* and 5*d*, the thickness of the spine is 0.3 mm. SCFC5 performs better in velocity and CoT. In FIGS.

5e-5f, the thickness of the spine is 0.35 mm. SCFC8 performs better in velocity and CoT.

Figure 6A:
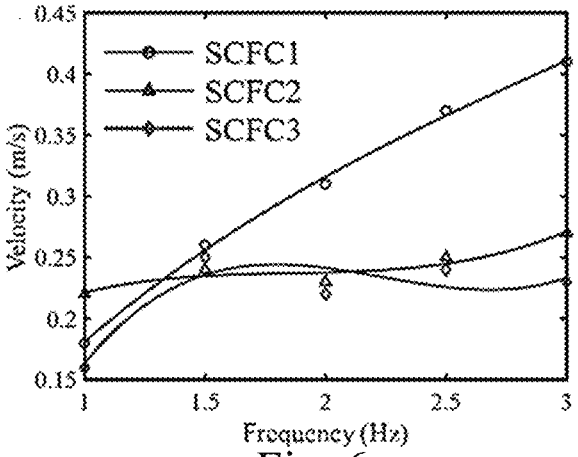
FIG. 6*a* illustrates comparison of the swimming velocity in the frequency domain between the robot with thickness combinations of SCFC1-3 for the bistable swimming mode.
Figure 6B:
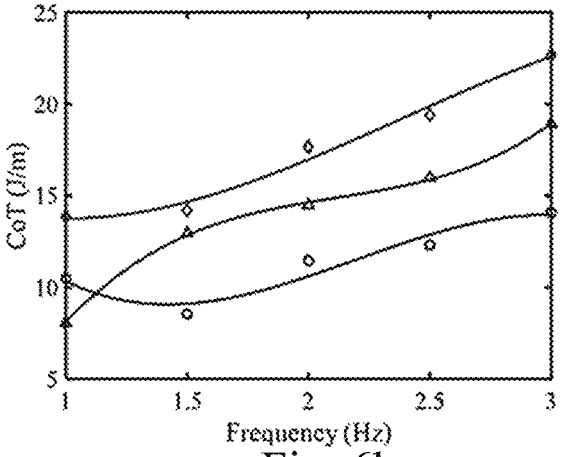
FIG. 6*b* illustrates comparison of the CoT in the frequency domain between the robot with thickness combinations of SCFC1-3 for the bistable swimming mode.
Figure 6C:
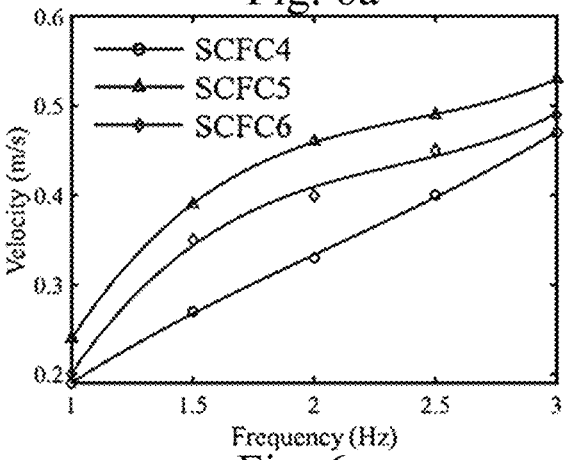
FIG. 6*c* illustrates comparison of the swimming velocity in the frequency domain between the robot with thickness combinations of SCFC4-6 for the bistable swimming mode.
Figure 6D:
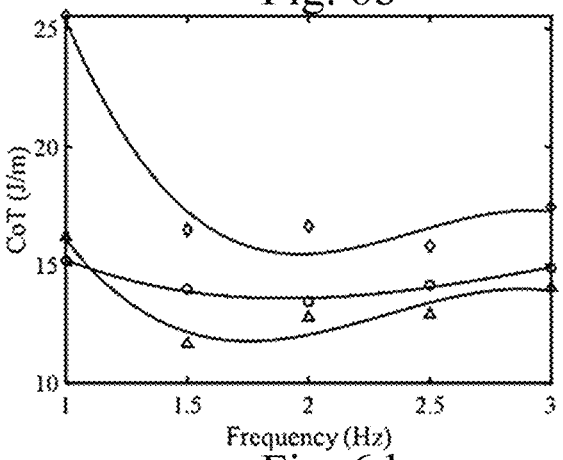
FIG. 6*d* illustrates comparison of the CoT in the frequency domain between the robot with thickness combinations of SCFC4-6 for the bistable swimming mode.
Figure 6E:
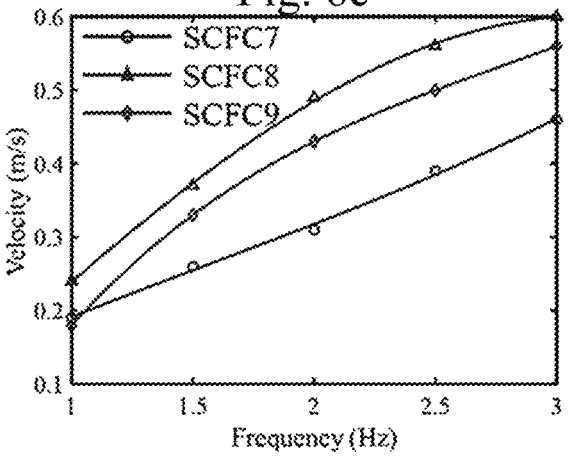
FIG. 6*e* illustrates comparison of the swimming velocity in the frequency domain between the robot with thickness combinations of SCFC7-9 for the bistable swimming mode.
Figure 6F:
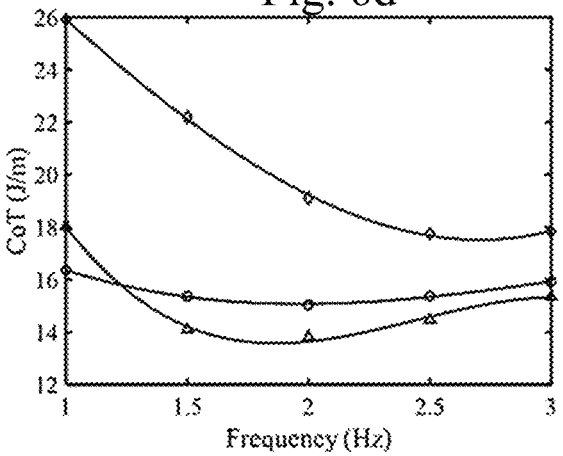
FIG. 6*f* illustrates comparison of the CoT in the frequency domain between the robot with thickness combinations of SCFC7-9 for the bistable swimming mode.

FIGS. 6a-6f shows further comparison of the swimming velocity and CoT in the frequency domain between the robot with all nine thickness combinations (that are shown in FIG. 4b) of the elastic spine and the caudal fin for the bistable swimming mode. In FIGS. 6a and 6b, the thickness of the spine is 0.25 mm. SCFC1 performs better in velocity and CoT. In FIGS. 6c and 6d, the thickness of the spine is 0.3 mm. SCFC5 performs better in velocity and CoT. In FIGS. 6e-6f, the thickness of the spine is 0.35 mm. SCFC8 performs better in velocity and CoT.

According to the analysis above, no case can produce the best performance both in swimming speed and CoT over the studied range of tail beat frequencies. However, the tests reveal that a stiff spine with a medium-stiff caudal fin provides faster speed with higher energy efficiency. Among all the combinations, SCFC8 enables the robot to obtain the maximum speed and the lowest CoT at high speed. Thus, for the subsequent tests, SCFC8 is selected for the robot.

Figure 7A:
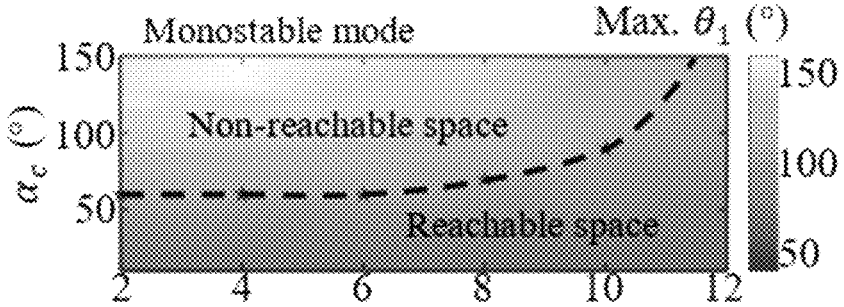
FIG. 7*a* shows the reachable space of control parameters for the monostable mode.
Figure 7B:
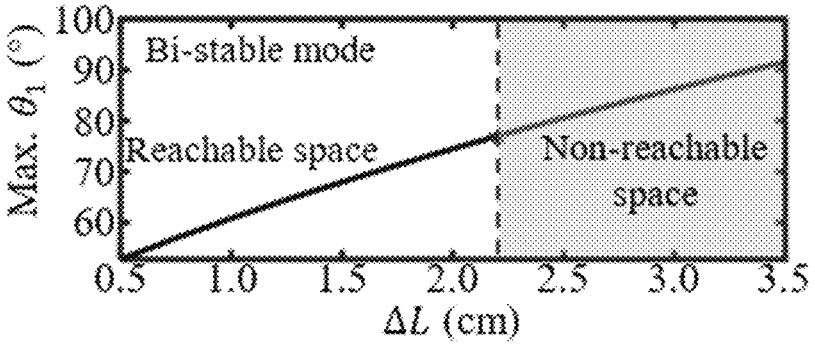
FIG. 7*b* shows the reachable space of control parameters for the bistable mode.
Figure 7C:
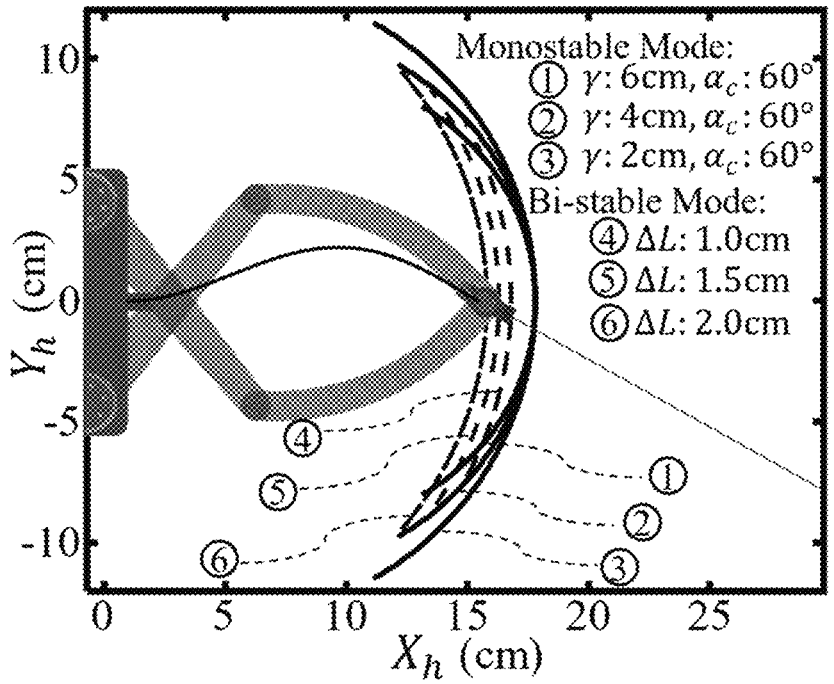
FIG. 7*c* shows different control trajectories for forward swimming.

Next, the forward swimming performance of the robot is investigated when the tail flaps with different trajectories. Due to the structure limitations ($\theta_1<77°$, $\theta_2>-77°$), the reachable parameter space of each trajectory needs to be investigated. FIGS. 7a-7b show the results of reachable spaces for trajectories of both monostable and bistable modes. The reachable space presents the maximum value of $\alpha_c$ for each trajectory of the monostable mode and the allowable precompression length ΔL of the elastic spine for the bistable mode. Six different trajectories are selected for the forward swimming tests as shown in FIG. 7c. Three trajectories belong to the monostable mode, and the trajectory with larger γ is not included because the amplitude is too small to get good performance on the speed. The other three trajectories pertaining to the bistable mode have different precompression of the elastic spine.

Figure 7D:
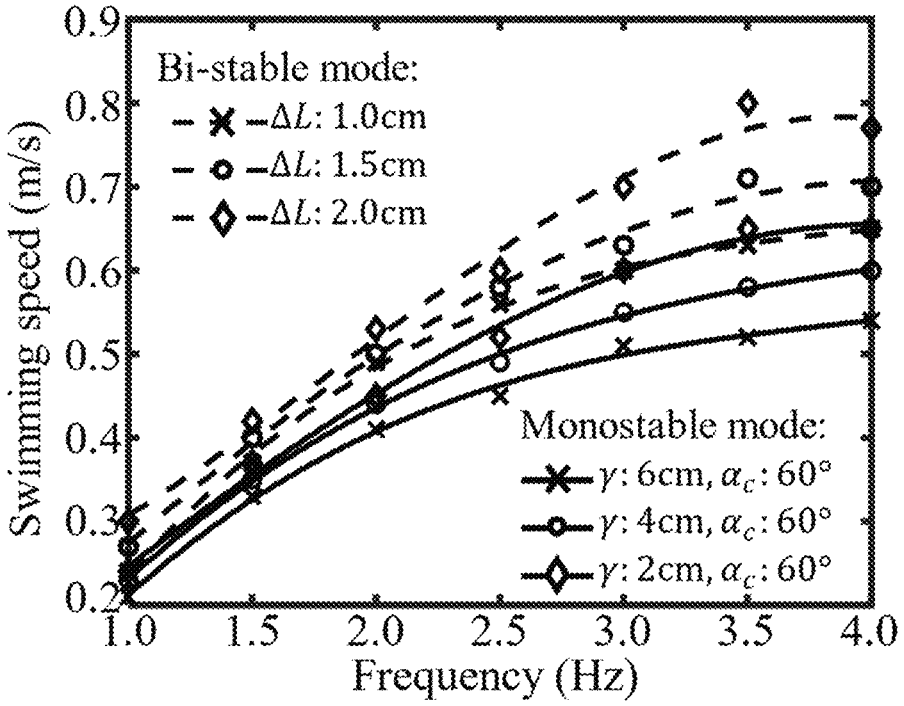
FIG. 7*d* illustrates average forward swimming speed comparisons of the robot with different control trajectories.
Figure 8A:
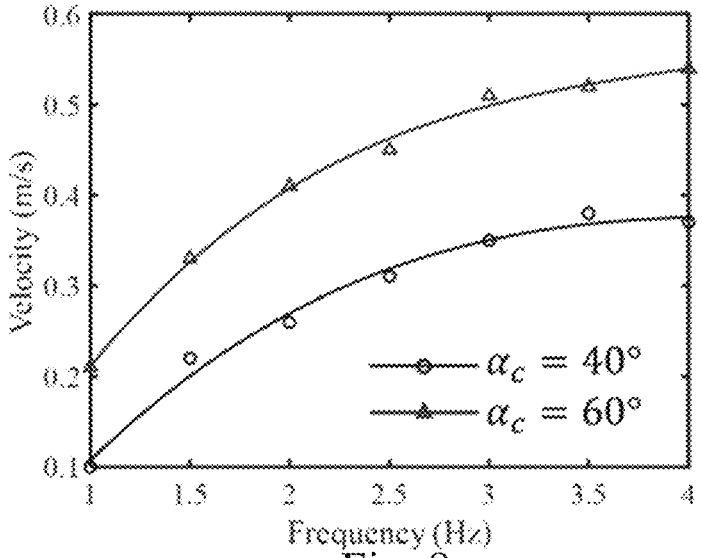
FIG. 8*a* illustrates a comparison of the swimming velocity in the frequency domain between the robot swimming with different tail beat amplitude for each trajectory of monostable mode, where γ of the trajectory is 6 cm.
Figure 8B:
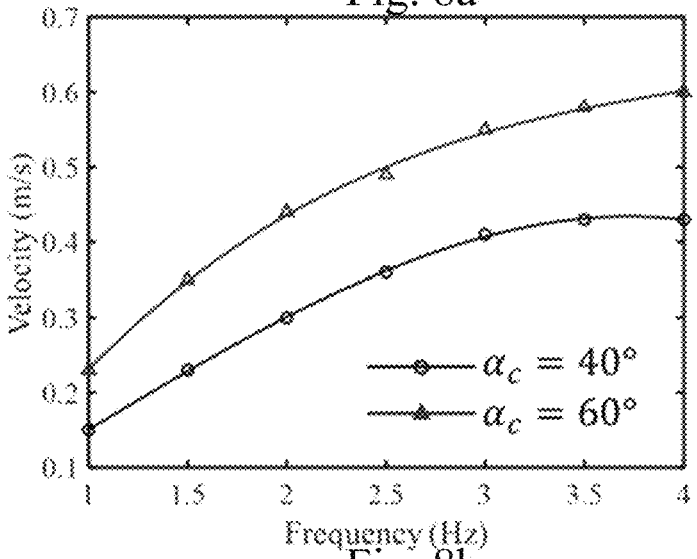
FIG. 8*b* illustrates a comparison of the swimming velocity in the frequency domain between the robot swimming with different tail beat amplitude for each trajectory of monostable mode, where γ of the trajectory is 4 cm.
Figure 8C:
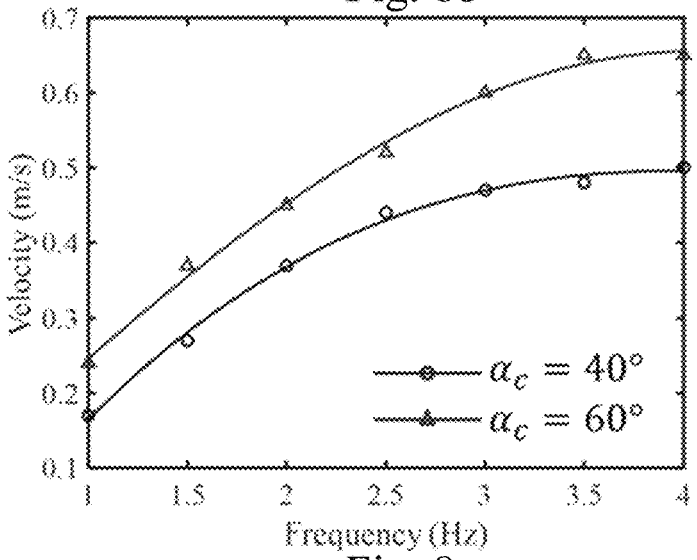
FIG. 8*c* illustrates a comparison of the swimming velocity in the frequency domain between the robot swimming with different tail beat amplitude for each trajectory of monostable mode, where γ of the trajectory is 2 cm.
Figure 9A:
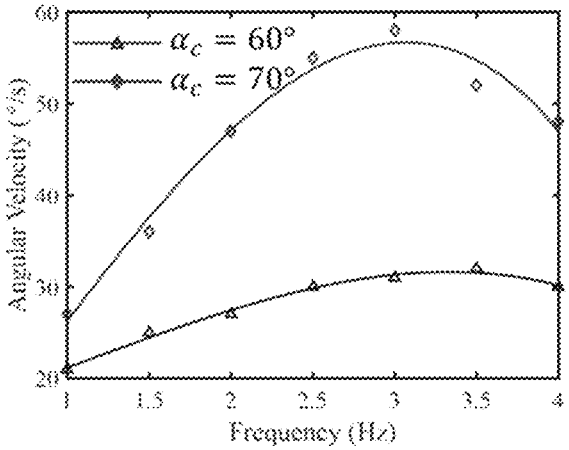
FIG. 9*a* illustrates the comparisons of angular velocity between the robot turning with different tail beat amplitude for each control trajectory, where γ of the trajectory is 8 cm.
Figure 9B:
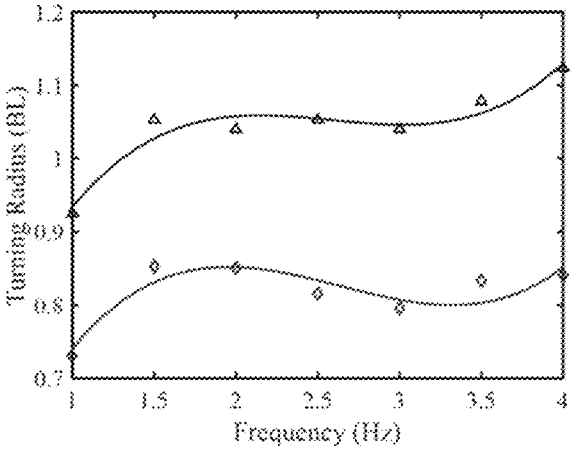
FIG. 9*b* illustrates the comparisons of turning radius between the robot turning with different tail beat amplitude for each control trajectory, where γ of the trajectory is 8 cm.
Figure 9C:
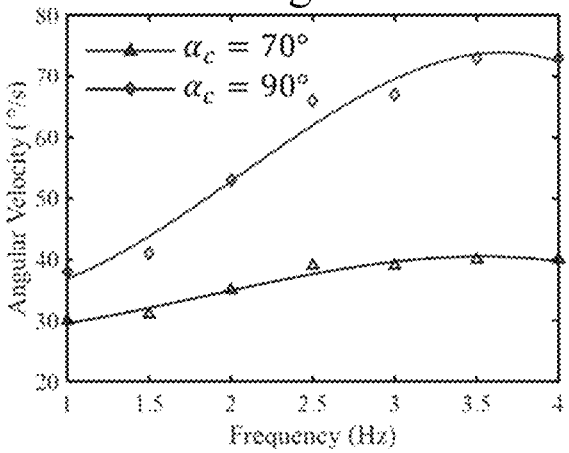
FIG. 9*c* illustrates the comparisons of angular velocity between the robot turning with different tail beat amplitude for each control trajectory, where γ of the trajectory is 10 cm.
Figure 9D:
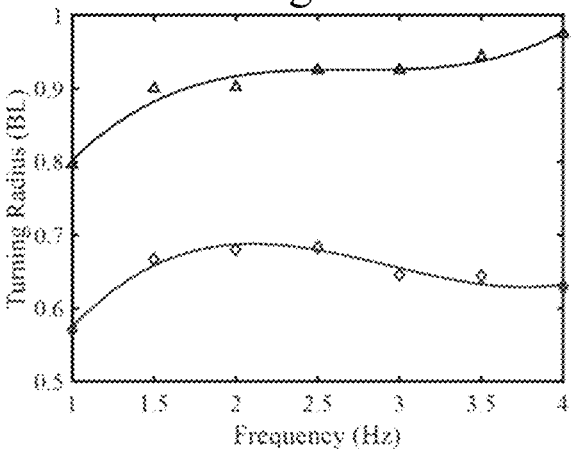
FIG. 9*d* illustrates the comparisons of turning radius between the robot turning with different tail beat amplitude for each control trajectory, where γ of the trajectory is 10 cm.
Figure 9E:
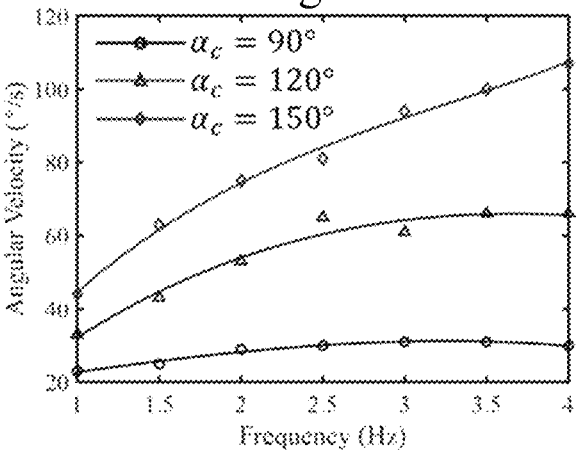
FIG. 9*e* illustrates the comparisons of angular velocity between the robot turning with different tail beat amplitude for each control trajectory, where γ of the trajectory is 12 cm.
Figure 9F:
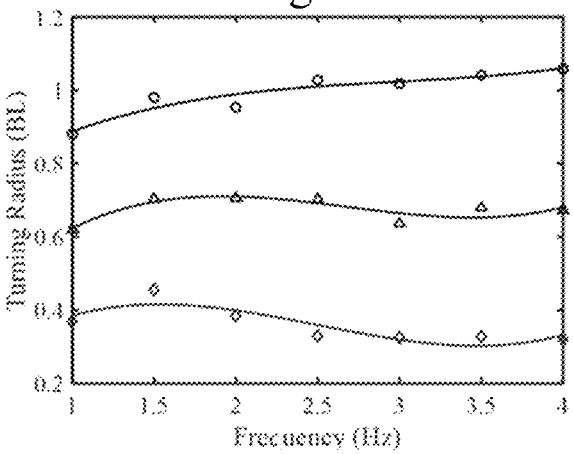
FIG. 9*f* illustrates the comparisons of turning radius between the robot turning with different tail beat amplitude for each control trajectory, where γ of the trajectory is 12 cm.

The results of the swimming speed are shown in FIG. 7d. For the monostable locomotion mode, the speed increases with the decrease of the value of γ, this is because with the same control angle $\alpha_c$, the amplitude is larger for the trajectory with smaller γ. The maximum average swimming speed of the monostable mode is around 0.65 m/s when the robot swims with the trajectory of γ=2 cm and the frequency of 3.5 Hz and 4 Hz. More speed comparisons of each trajectory with different amplitude for the monostable mode are provided in FIGS. 8a-8c. As for the bistable swimming mode, the average speed is dramatically increased compared to the monostable mode. With a higher compression rate of the elastic spine, more improvement of the speed can be achieved. The reason is that a larger compression rate induces more prestored elastic strain energy of the spine, which will boost more the thrust. The highest average swimming speed that can be achieved by the bistable mode is about 0.80 m/s at the frequency of 3.5 Hz and the compression length ΔL equal to 2.0 cm.

Figure 7E:
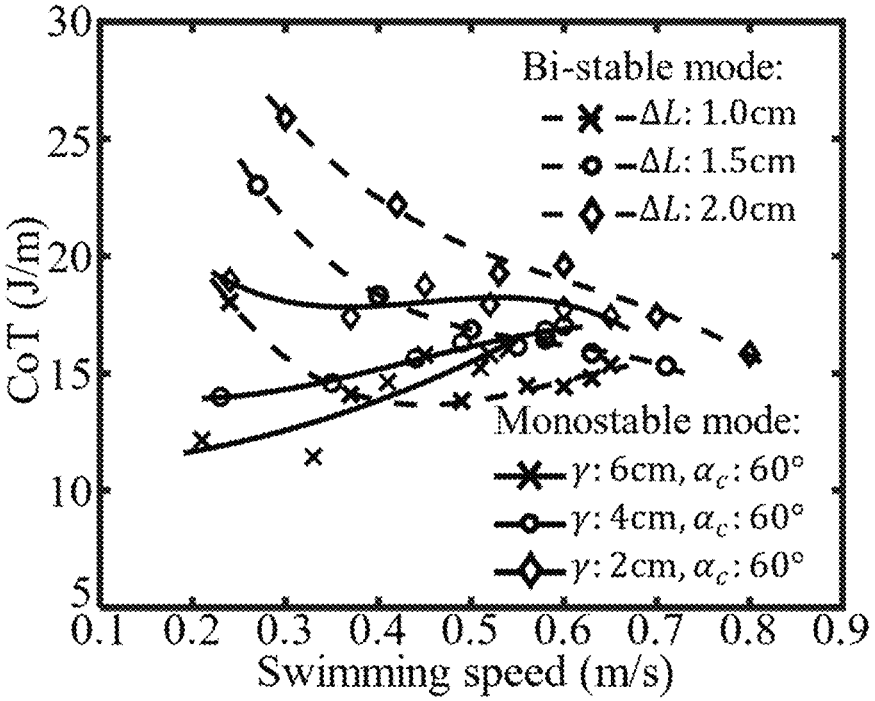
FIG. 7*e* illustrates cost of transport comparisons of the robot with different control trajectories.

FIG. 7e compares the results of CoT when the robot swims with different tail-flapping trajectories. When the robot swims in the monostable mode, the trajectory with a large γ exhibits a higher energy efficiency than that of the trajectory with a small γ. The trajectory of γ=6 cm is more energy efficient than the other two trajectories. Regarding the bistable locomotion mode, a large compression rate of the elastic spine leads to higher energy consumption. Among the three trajectories of the bistable mode, the one with the compression length ΔL of 1 cm achieves the lowest CoT. Through further comparisons between the CoT of the monostable and bistable modes, it is found that the robot can swim energy efficiently with the monostable mode at low speed and with the bistable mode at high speed. For example, it is better for the robot to use the monostable mode with the trajectory of γ=2 cm when the swimming speed is below 0.40 m/s and to use the bistable mode with the trajectory of ΔL=1 cm when the swimming speed is higher than 0.40 m/s.

Figure 7F:
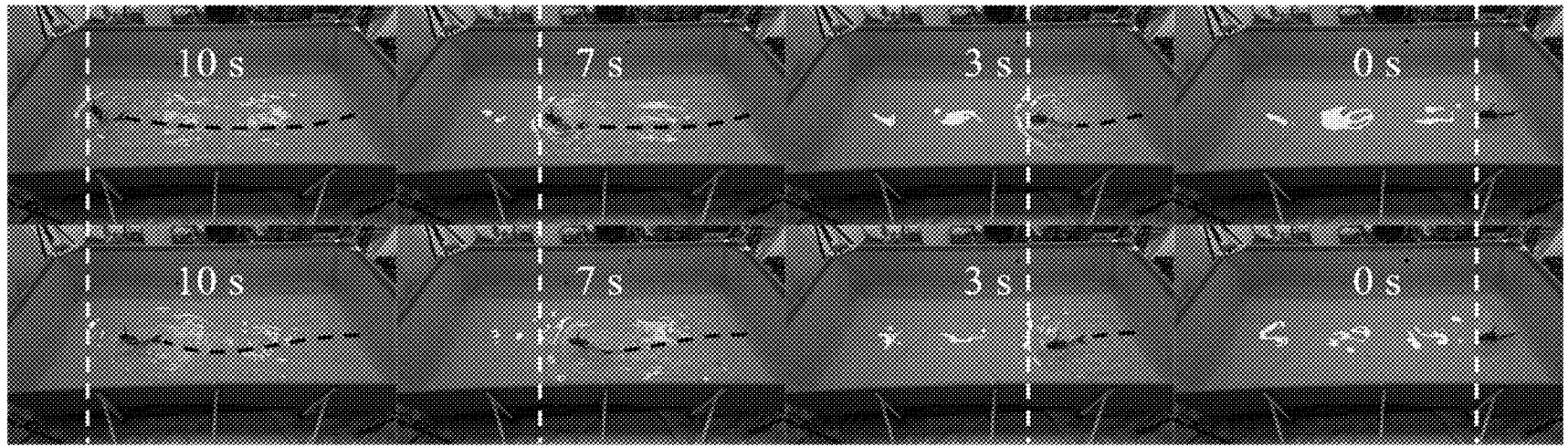
FIG. 7*f* illustrates comparison of the swimming between the bistable mode (Top) and the monostable mode (Bottom).

FIG. 7f shows the snapshots of swimming comparison between the bistable and monostable modes under the frequency of 1 Hz. For bistable mode, the precompression length ΔL is 2 cm, and for monostable mode, the γ of the trajectory is 2 cm.

Figure 10A:
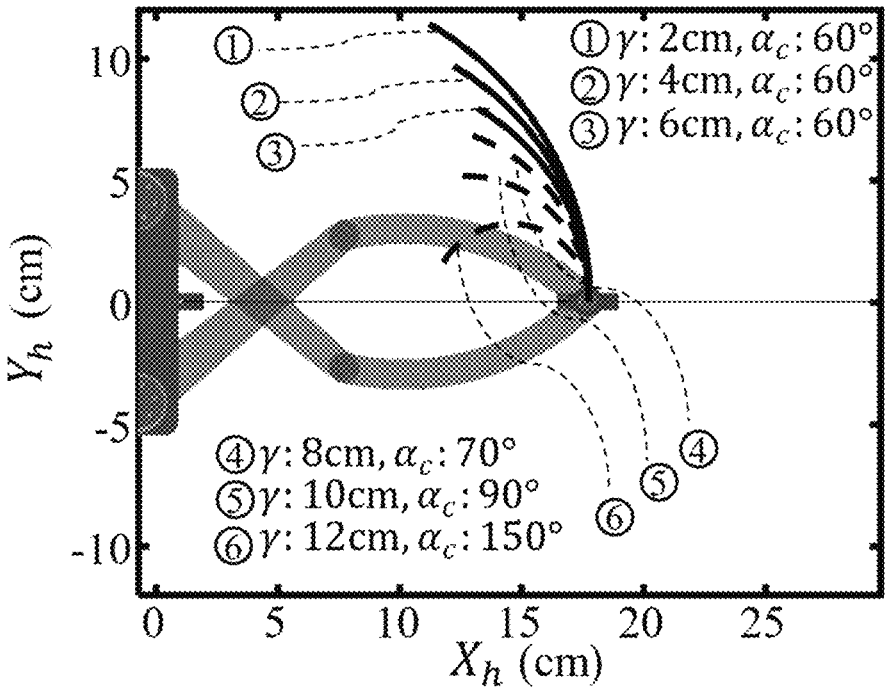
FIG. 10*a* illustrates six different control trajectories used for comparing turning performance.

Next, the turning performance of the robot with different tail beat trajectories is compared. Six trajectories are selected with γ varying from 2 cm to 12 cm for the turning performance exploration as shown in FIG. 10a. Only the results of the trajectories with their maximum control angle $\alpha_c$ are presented here, and the comparisons for several trajectories with different $\alpha_c$ are described in FIG. 9a-9f. In FIG. 10a, the results reveals that the bistable fishtail can achieve the fastest turning rate and smallest turning radius simultaneously with the tail beat trajectory of small radius and large bending angle (the dashed line indicated by ⑥ in FIG. 10a).

Figure 10B:
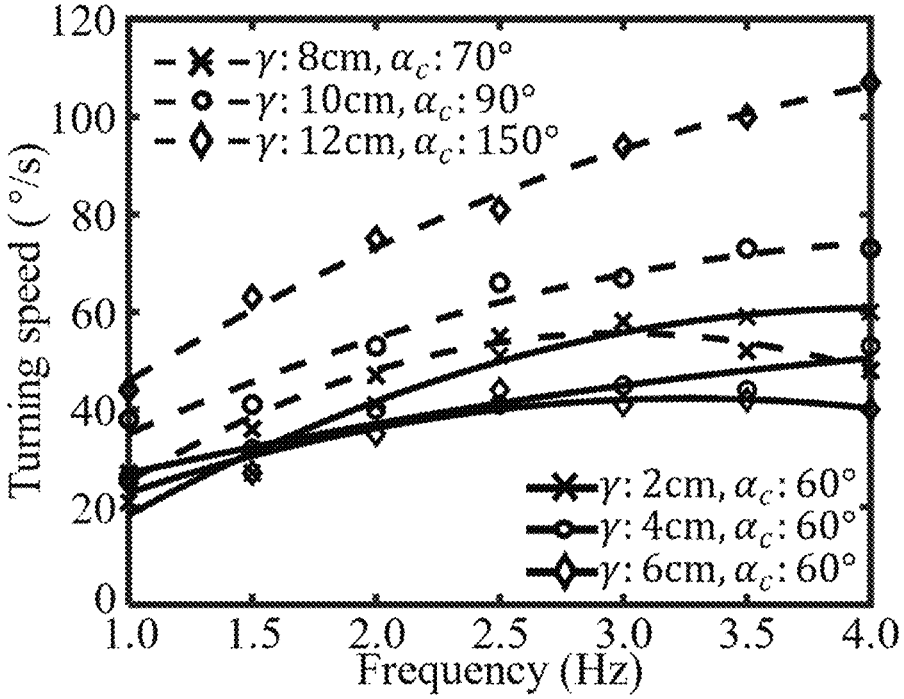
FIG. 10*b* shows average turning speed comparisons of the robot with the six different control trajectories.
Figure 10C:
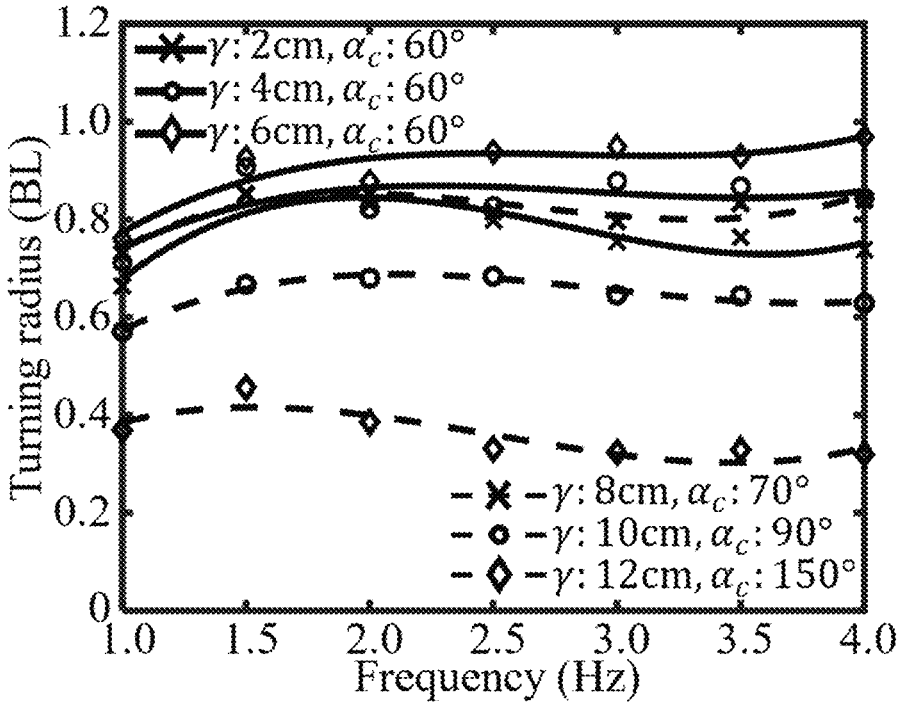
FIG. 10*c* illustrates turning radius comparisons of the robot with the six different control trajectories.

FIG. 10b shows the results of the average turning speed for the robot under various control trajectories. It is found that the variation trend of the average turning rate drops initially and then goes up significantly with the decrease in the radius of the tail beat trajectory. The maximum turning speed can be achieved by the trajectory of γ=6 cm is the smallest than that of the other trajectories. And among all trajectories, the highest average turning speed is around 107°/s when the robot turns with the trajectory of γ=2 cm and the frequency of 4 Hz. Similar to the effect of the tail trajectory on the turning rate, the turning radius presents earlier increase and later decrease trend (FIG. 10c). The robot turns in the path with the largest radius when the γ of the trajectory is 6 cm, while the robot driven by the trajectory of γ=2 cm shows the minimum turning radius at the frequency of 4 Hz. The minimum turning radius is 17 cm, equivalent to 0.31 body length per second.

Figure 10D:
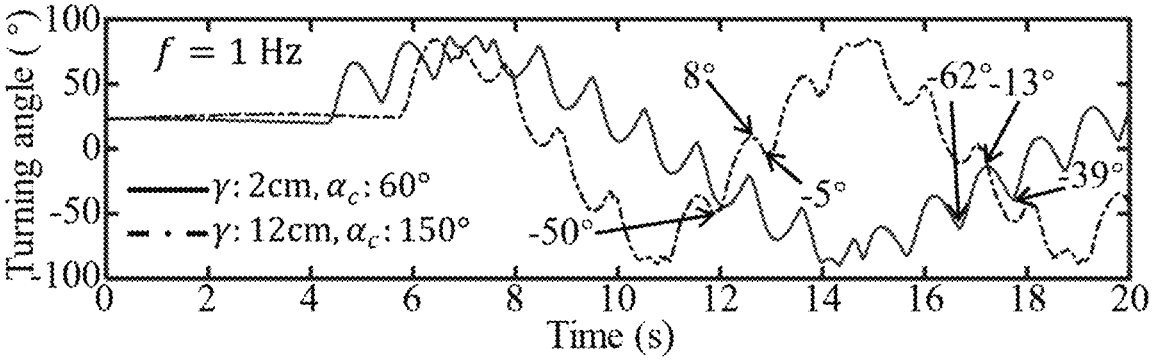
FIG. 10*d* illustrates comparisons of the turning angle in the time domain between the trajectory of 2 cm γ and 60° $\alpha_c$ and the trajectory of 12 cm γ and 150° $\alpha_c$ when tail beat frequencies are 1 Hz.
Figure 10E:
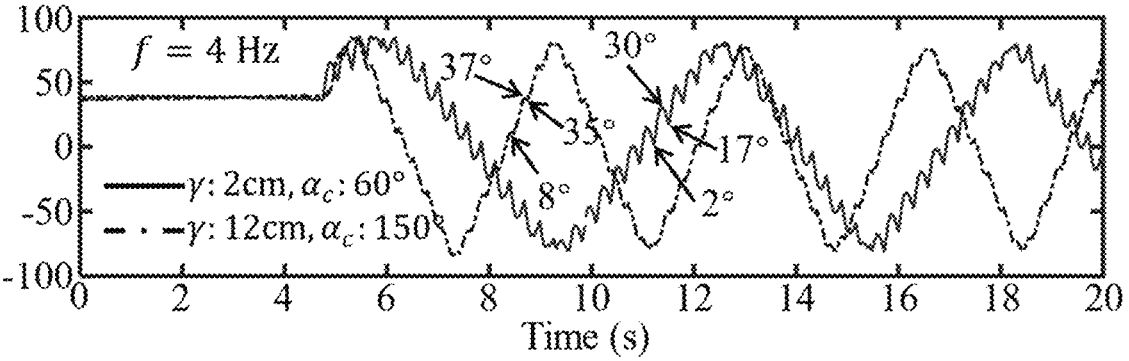
FIG. 10*e* illustrates comparisons of the turning angle in the time domain between the trajectory of 2 cm γ and 60° $\alpha_c$ and the trajectory of 12 cm γ and 150° $\alpha_c$ when tail beat frequencies are 4 Hz.

FIG. 10d and FIG. 10e further compare the turning angle in the time domain between the robot driven by the trajectories of large (γ=2 cm) and small (γ=12 cm) radius. In FIGS. 10d and 10e, it shows one stroke of the tail flapping with the trajectory of 12 cm γ and 150° $\alpha_c$ enables the robot to have a larger turning angle and a much smaller recovery angle. At the frequency of 1 Hz, one cycle of the tail flapping can generate 49° of the turning angle during the loading stroke with a recovery angle of 26° during the return stroke for the robot with the control trajectory of γ=2 cm. While for the trajectory of γ=12 cm, the robot can turn 58° with one stroke of the tail flapping, and the recovery angle is just a half compared to the robot turns under the trajectory of γ=2 cm. When the frequency is 4 Hz, one stroke of the tail flapping generates almost the same turning angle for the robot with the control trajectories of γ=2 cm and γ=12 cm (28° and 29°, respectively). However, during the return stroke, the recovery angle of the trajectory of γ=12 cm is much less than that of the trajectory of γ=2 cm, which are 2° and 13° respectively.

Figure 10F:
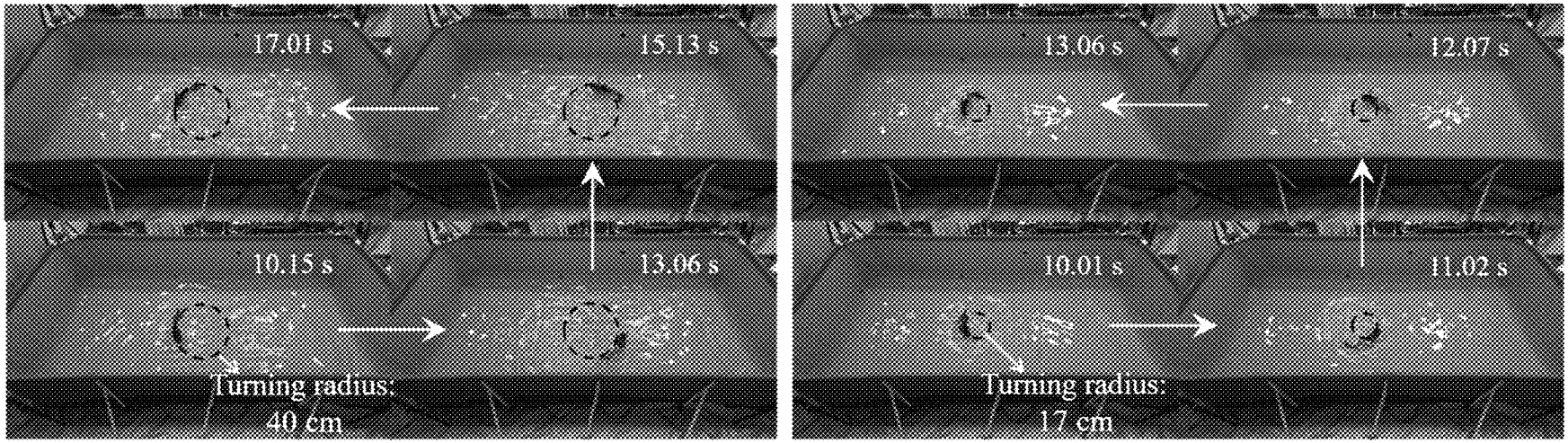
FIG. 10*f* shows comparison of the turning between the trajectory of a large radius (Left) and the trajectory of a small radius (Right).

FIG. 10f demonstrates the snapshots of the turning performance comparison between the robot turns with the tail beat trajectories of large and small radii under the frequency of 4 Hz. For the trajectory of a large radius, γ=2 cm, and for the trajectory of a small radius, γ=12 cm.

The performance of the robot as shown in FIGS. 1*a*-1*f* (hereinafter "the proposed robot") is compared with several similar reported robotic swimmers. The performance indicators include swimming speed, energy efficiency, turning speed, and turning radius. To make the evaluation benchmark more reasonable, the differences in the achievable maximum tail beat frequency and the mass of robots need to be taken into consideration. The stride length (SL=V/f) is used to reflect the swimming speed of the robotic swimmers, which denotes the traveled distance of the robot during one complete tail beat period [32]. Energy efficiency is characterized by the consumed energy for moving a unit mass over a unit distance (CoT/mass) [33].

Figure 11A:
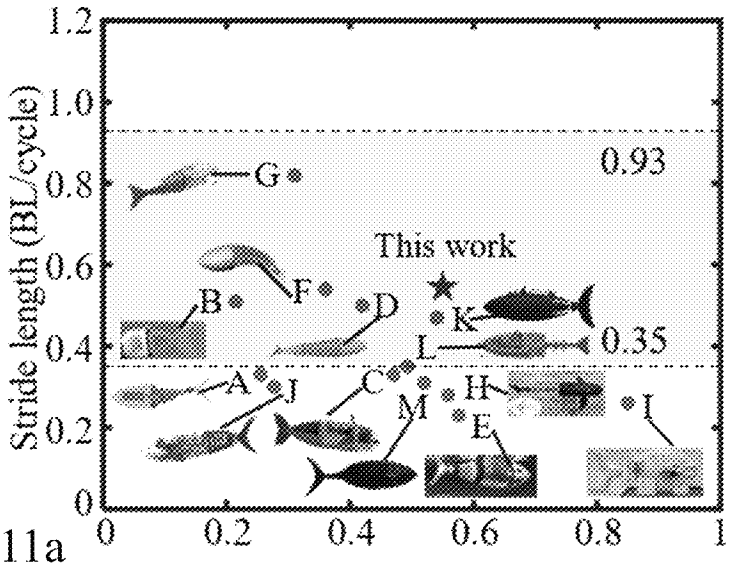
FIG. 11*a* illustrates a comparison of stride length versus tail beat frequency for the proposed robot as compared to similar robotic swimmers in literature [27], [31], [34]-[44].
Figure 11B:
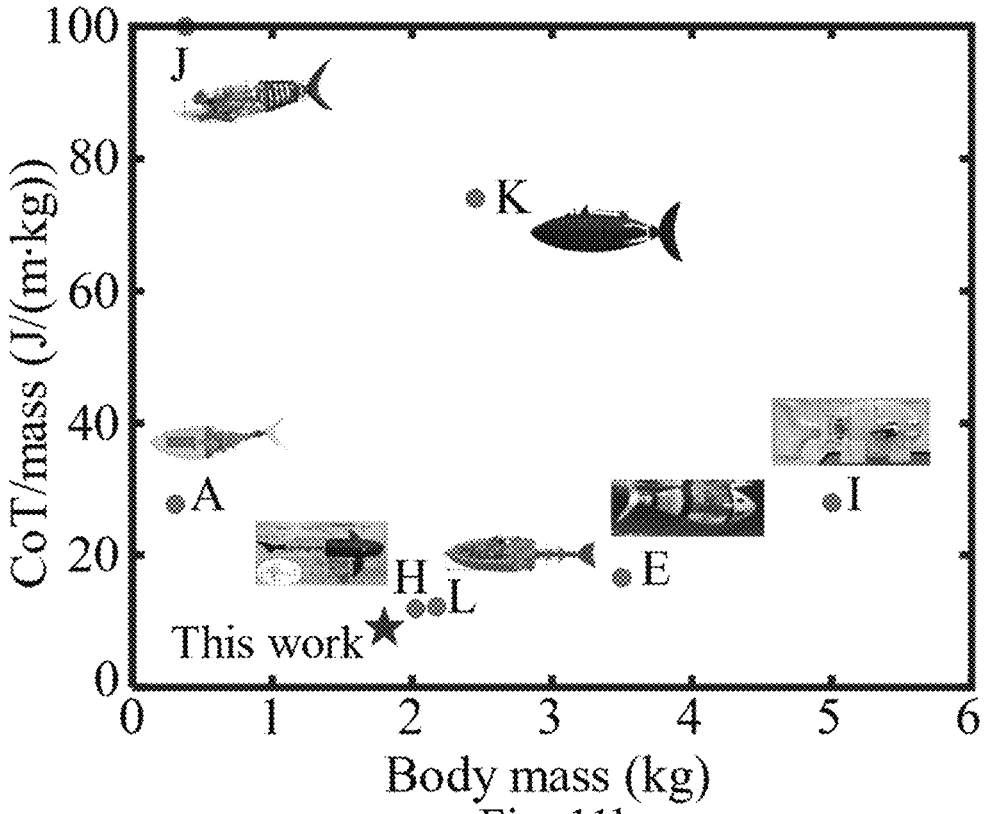
FIG. 11*b* shows a comparison of energy consumption for moving a unit mass over per unit distance (CoT/mass) versus body mass at the maximal average swimming speed of the robots.
Figure 11C:
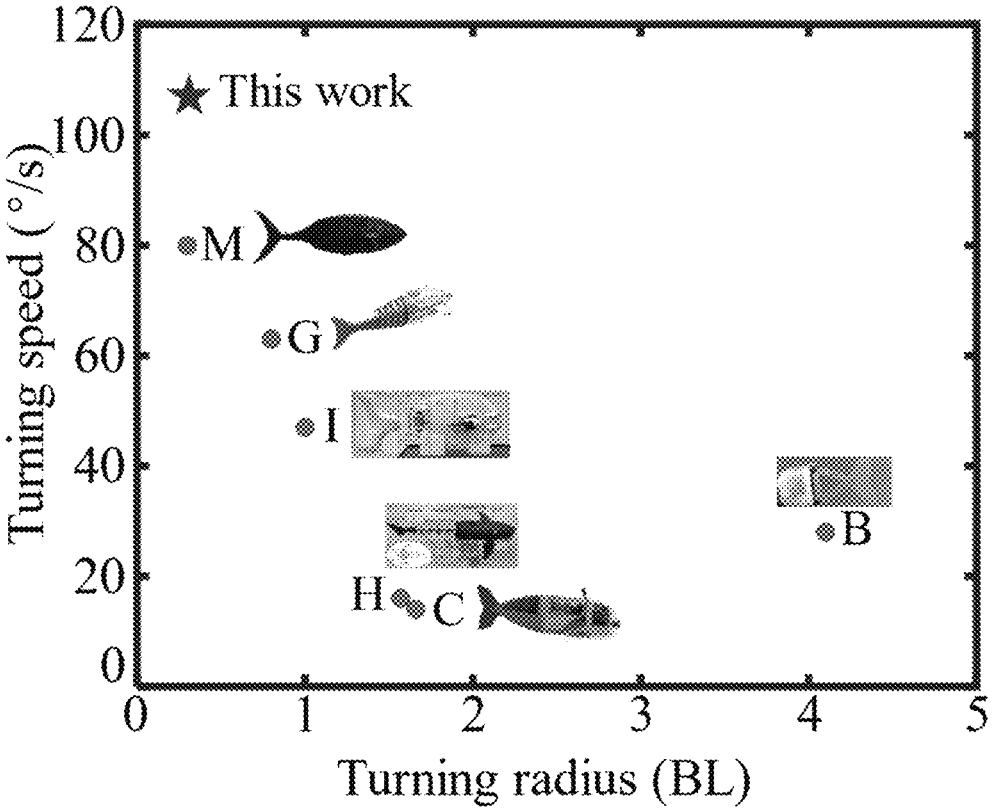
FIG. 11*c* shows a comparison of maneuverability in terms of turning speed and turning radius.

FIG. 11*a* shows the comparison of the stride length. The average SL of fish varies from 0.35 to 0.93 BL/cycle [45], the part highlighted by the grey color in the figure. The proposed robot achieves the fastest average swimming velocity in the bistable locomotion mode when the precompression length of the spine is 2 cm. Thus, the maximum SL under each tested tail beat frequency ranges from 0.35 to 0.55 BL/cycle, which shows comparable swimming speed with the real fish in nature. And the maximum stride length (0.55 BL/cycle) achieved at the frequency of 1 Hz is higher than most compared platforms and only lower than one platform, ACPM robotic fish [38]. But the length of the ACPM robotic fish is much smaller than that of the proposed robot. FIG. 11*b* compares the energy efficiency when the robots swim at the maximum velocity. It is clear to see that the robotic swimmer in this work consumes the minimal energy at its maximum average swimming speed when compared to other platforms, which means the proposed robot can achieve fast speed with a high energy efficiency. The proposed robot also exhibits excellent maneuverability when compared with other robotic swimmers (FIG. 11*c*). The fastest turning rate with the minimal turning radius demonstrates that its maneuverability is strongly superior to other platforms.

In summary, the embodiment of FIGS. 1*a*-1*f* show a compliant robotic fish tail based on the bistable nonlinear mechanism, which combines a parallel linkage mechanism and an elastic spine. The active controlled elastic spine endows the robot tail with high controllability and flexibility, which allows the robot to swim and turn with different predefined tail beat trajectories. The tunable and controllable bistability of the robot tail can perform two different motion modes freely and accurately (monostable and bistable mode).

Firstly, the study on different stiffness combinations of the elastic spine and the caudal fin reveals that the spine thickness and caudal fin stiffness are two fundamental factors for improving swimming performance (see FIGS. 5*a*-6*f*), and it is noted that a soft spine combined with a soft caudal fin performs better in both speed and CoT when compared to a soft spine combined with other two stiffer caudal fins (see FIGS. 5*a*-6*f*). It is also noted that a stiff spine with a caudal fin of medium stiffness enable the robot to swim faster (see FIG. 4*c*), but no combination can exhibit the best energy efficiency over a wide range of swimming speeds (see FIG. 4*d*). At a lower speed, the robot with a soft spine and a soft caudal fin (compared to stiff or medium ones in FIG. 4*b*) is more energy efficient, while at a higher speed, the energy efficiency of the robot with a stiff spine and a moderately stiff caudal fin is better.

Secondly, switchable tail beating modes benefiting from the accurately controlled spine not only help the robotic tail to take advantage of the elastic instability for effectively amplifying the thrust force (see FIG. 7*d*), but also allow the robot to maintain higher energy efficiency at different speed through switching modes (see FIG. 7*e*). Compared to the traditional soft swimmers either using passive compliant tail [46] or actuated by hydraulic soft tail [34], the proposed robot shows much better propulsive performance owing to its controllability of the tail trajectory and nonlinear stiffness. Compared with other bistable swimmers [27], [28], the tunable and controllable bistability makes the robot tail more flexible and powerful, which is beneficial to real applications.

Thirdly, the maneuverability of the robotic swimmer can be largely enhanced through selecting the most suitable tail beat trajectory for turning. The active controlled spine allows the robot to simulate the smooth and continuous motion morphology of fish, which is difficult to be realized by other robotic fish built by discrete rigid linkages [10]. This property enables the robot to turn with the most efficient tail motion morphology like a real fish (the tail beat trajectory indicated by ① in FIG. 10*a*). Based on the results of turning tests, the tail beat trajectory of a small radius and a large bending angle empower the robotic swimmer to have a faster turning rate (see FIG. 10*b*) and a smaller turning radius (see FIG. 10*c*).

The robotic swimmer successfully demonstrates its superior performance in terms of swimming speed, maneuverability, and energy efficiency through extensive comparisons with other similar robots in literature (see FIGS. 11*a*-11*c*). In the comparisons, several platforms have similar tail actuation mechanisms, but can only realize single motor-actuated reciprocating motion with high tail beat frequency [31], [40]-[43]. Thus, the swimming speed of these robots can be faster. However, the robots of this kind are difficult to realize turning motion, as a result, their maneuverability is relatively worse and some even can only swim forward. Moreover, most electronic components of a platform, Tunabot [31], are placed outside the robot. All these mentioned drawbacks show a high restriction on practical applications. It is noted that, the robot of this study can achieve a reasonable forward speed (although not the fastest because of the tail beat frequency), and it is more applicable to the marine environments due to these features as discussed before including self-contained compact system, high energy efficiency, and excellent maneuverability.

Therefore, the tail mechanism according to exemplary embodiments of the invention provides a more reliable way for reproduction of real fish swimming skills and the results definitely unveil a benchmark solution to the development of soft actuation of underwater robots.

Figure 12:
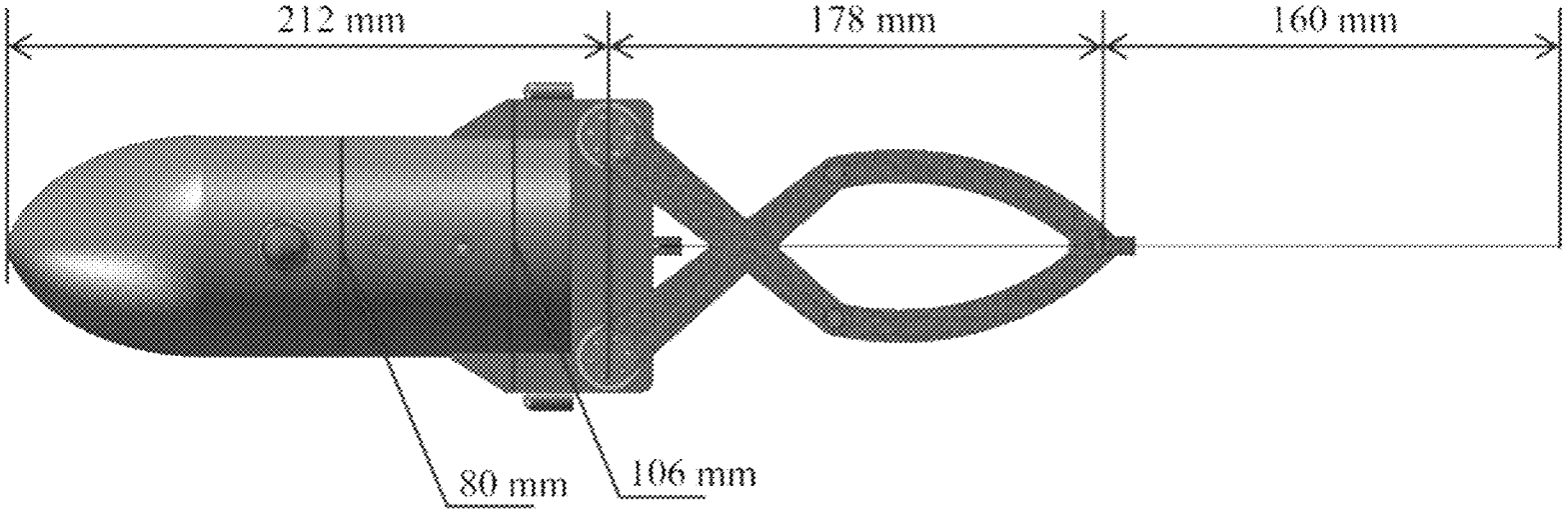
FIG. 12 shows detailed dimensions of a prototype of robotic fish made for conducting the various tests.

Next, the hardware implementation details and physical dimensions of the prototype of the robotic made according to the design in FIGS. 1*a*-1*f*, and used for conducting the various tests from FIGS. 4*a*-11*c*, will be provided. The rigid head was printed with the material of ABS plastic by the 3D printer and was sealed by silicon rubber. Each bar of the parallel mechanism was fabricated by CNC and was made up of carbon fiber, which is lightweight but has high strength. The materials of the elastic spine and the caudal fin are 65Mn steel and carbon fiber respectively, and both shapes of them were produced by laser cutting. The water resistance of two active rotational joints was promised by the rotary sealing ring (Trelleborg Turcon). The detailed dimension of the robot is shown in FIG. 12. The dimensions of the entire robot are 550 (L)×106 (W)×120 (H) $mm^3$ and it weighs 1.8 kg.

Figure 13:
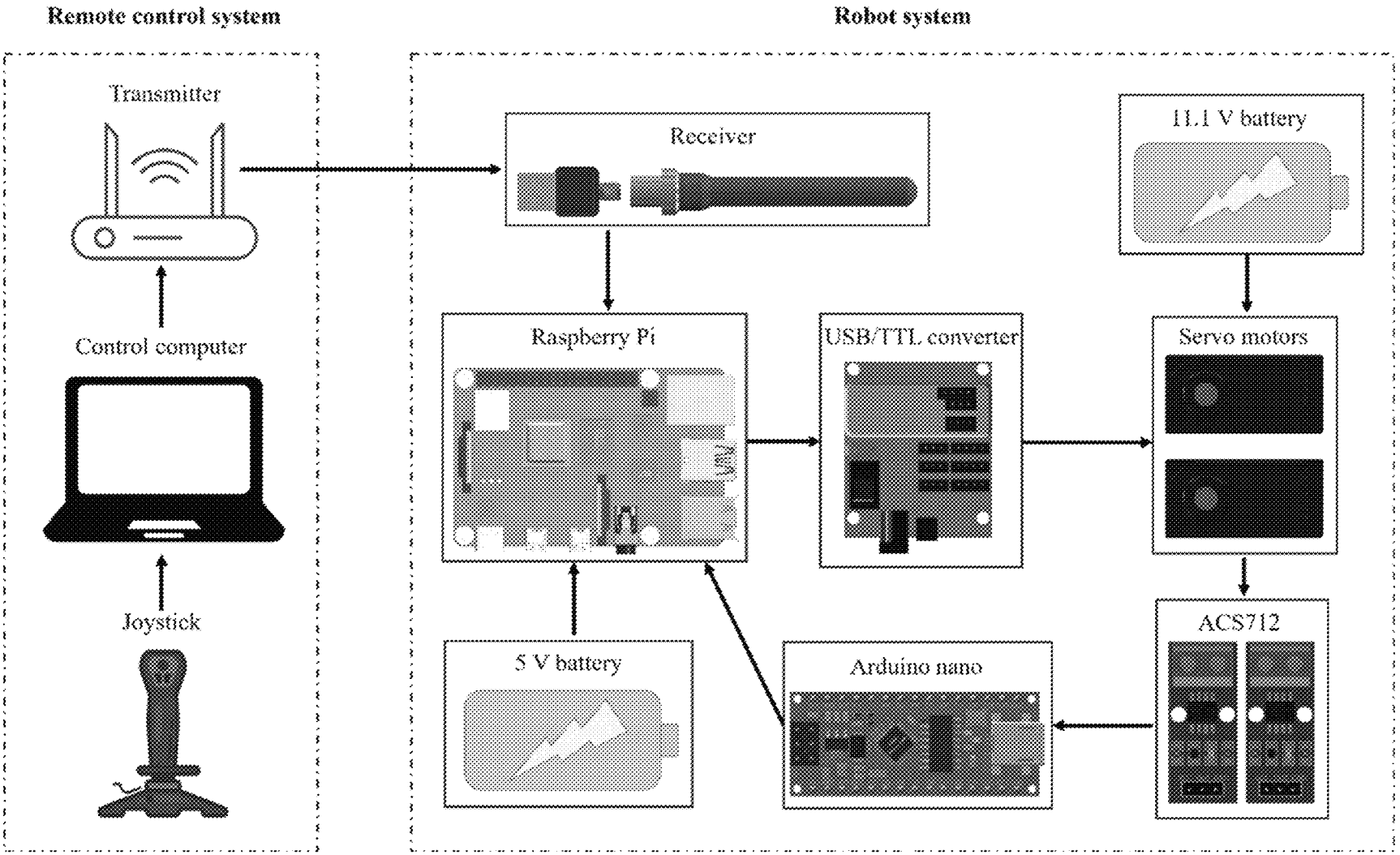
FIG. 13 shows an overview of the remote-control system for the robotic fish prototype.

The electronic components are presented in FIGS. 1*c*-1*d*. The main microcontroller is a Raspberry Pi 4B, which is used to control motors and acquire data from sensors. The active rotational joints are actuated by two servo motors with the normal torque of 2.5 Nm. The communication between the main controller and the motors relies on one TTL/USB converter. Two sensors ACS712 are able to measure the current of two motors and the data is read by the Arduino nano. Two rechargeable batteries are used to power the controller (5 V) and the motors (11.1 V). The wireless communication between the Raspberry Pi and the computer is achieved by the 2.4 GHz transmitter and receiver. The flow diagram of the remote-control system is shown in FIG. 13.

Free swimming tests that have been presented above were conducted in a small laboratory swimming pool with the dimensions of 4 m×2 m×1 m. On the corners of the pool, four tracking cameras were installed at 3 m height. The tracking cameras were connected to the laptop by an 8-port Ethernet switch (TPE-TG80g) and cables. Infrared reflective markers were installed on the head of the robot. The setup can track the position of the robot while it swims in the pool. The tracking data was then used to get the trajectory and velocity information of the robot.

A separate rechargeable Li-ion battery with a voltage of 11.1 v and a capacity of 4900 mAh was used to power two servo motors. To estimate the power consumption of two motors, two current sensors (ACS712 with a current range of 5 A) are connected into the electric circuit to measure the current of the motors separately. The output of the current sensor is analog data, and the Raspberry Pi does not have the analog-to-digital converter (ADC), thus an Arduino nano was utilized to read the current sensors through its built-in ADC and then the data was sent to and stored in the Raspberry Pi. Finally, the power can be evaluated by the voltage and current.

The exemplary embodiments are thus fully described. Although the description referred to particular embodiments, it will be clear to one skilled in the art that the invention may be practiced with variation of these specific details. Hence this invention should not be construed as limited to the embodiments set forth herein.

While the embodiments have been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

What is claimed is:

1. A device for providing propulsion in water, the device comprising:

a) an elongated elastic member comprising a fixed end and a free end;

b) a parallel linkage mechanism comprising a first link and a second link; and c) a propelling member connected to the free end of the elongated elastic member;

wherein a first end of the first link is fixedly located relative to the fixed end of the elongated elastic member; the first end of the first link adapted to pivot by a first servo motor; a first end of the second link fixedly located relative to the fixed end of the elongated elastic member; the first end of the second link adapted to pivot by a second servo motor; and wherein a second end of the first link and a second end of the second link are pivotally connected to each other, as well as to the free end of the elongated elastic member, to form a passive rotational joint; a motion of the propelling member being determined by a moving trajectory of the passive rotational joint; and wherein the motion of the propelling member is adapted to be switched between a monostable mode and a bistable mode.

2. The device of claim 1, wherein the first link comprises a first driving member, and a first driven member pivotally connected to the first driving member; the first end of the first link being an end of the first driving member away from the first driven member;

the second end of the first link being an end of the first driven member away from the first driving member; the second link comprising a second driving member, and a second driven member pivotally connected to the second driving member; the first end of the second link being an end of the second driving member away from the second driven member; the second end of the second link being an end of the second driven member away from the second driving member.

3. The device of claim 2, wherein a projection of the first driving member on a plane to which a pivoting axis of the passive rotational joint is normal, and a projection of the second driving member on the plane, cross each other to form a X shape.

4. The device of claim 3, wherein the first driven member and the second driven member each have a concave shape, the concave shapes of the first driven member and the second driven member facing each other.

5. The device of claim 1, further comprises a controller coupled to the first servo motor and the second servo motor, and configured to actuate the first servo motor and the second servo motor according to a predetermined pattern.

6. The device of claim 1, wherein the predetermined pattern is derived from an inverse kinematics of the parallel linkage mechanism.

7. The device of claim 1, wherein the parallel linkage mechanism further comprises a third link and a fourth link; the third link being parallel to and adapted to move in synchronization with the first link; the fourth link being parallel to and adapted to move in synchronization with the second link.

8. The device of claim 1, wherein the device is included in a robotic fish; the elongated elastic member being an elastic spine of the robotic fish; the propelling member being a compliant caudal fin.

9. The device of claim 1, further comprising a housing; the fixed end of the elongated elastic member, the first servo motor and the second servo motor being mounted on the housing.

10. The device of claim 1, wherein the first end of the first link and the first end of the second link are symmetrically located about a virtual line that passes through the fixed end of the elongated elastic member.

11. The device of claim 1, wherein the propelling member is configured to provide a turning force to a submersible robot.

12. The device of claim 1, wherein the propelling member is configured to provide a locomotion force to a submersible robot.

13. The device of claim 1, wherein the elongated elastic member has a strip shape.

14. The device of claim 1, wherein the passive rotational joint comprises a housing, a shaft rotatably received within the housing, and a bearing connected between the shaft and the housing; the housing connected to the elongated elastic member and the propelling member; the shaft fixedly connected to one of the first link and the second link, and rotatably connected to the other one of the first link and the second link.

15. A robotic fish, comprising:

a) a head comprising a housing;

b) a battery received within the housing;

c) a controller received with the housing;

d) an elastic spine comprising a fixed end mounted to the housing, and a free end;

e) a complaint caudal fin connected to the free end of the elastic spine; and f) a parallel linkage mechanism comprising a first link and a second link;

wherein a first end of the first link is pivotally connected to the housing; the first end of the first link adapted to pivot by a first servo motor secured to the housing; a first end of the second link pivotally connected to the housing; the first end of the second link adapted to pivot by a second servo motor secured to the housing; the first and second servo motors adapted to be driven by the controller; and wherein a second end of the first link and a second end of the second link are pivotally connected to each other, as well as to the free end of the elastic spine, to form a passive rotational joint; a motion of the caudal fin being determined by a moving trajectory of the passive rotational joint; and wherein the motion of the caudal fin is adapted to be switched between a monostable mode and a bistable mode.

* * * * *